US009982848B2

(12) United States Patent
Xu et al.

(10) Patent No.: US 9,982,848 B2
(45) Date of Patent: May 29, 2018

(54) LED TUBE LAMP

(71) Applicant: JIAXING SUPER LIGHTING ELECTRIC APPLIANCE CO., LTD, Jiaxing Zhejiang (CN)

(72) Inventors: Hong Xu, Jiaxing (CN); Chang Yang, Jiaxing (CN); Wentao Yoa, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 90 days.

(21) Appl. No.: 15/058,004

(22) Filed: Mar. 1, 2016

(65) Prior Publication Data

US 2016/0178135 A1 Jun. 23, 2016

Related U.S. Application Data

(63) Continuation of application No. PCT/CN2015/096501, filed on Dec. 5, 2015.

(30) Foreign Application Priority Data

Dec. 5, 2014 (CN) ..... 2014 1 0734425
Feb. 12, 2015 (CN) ..... 2015 1 0075925
(Continued)

(51) Int. Cl.
*F21K 99/00* (2016.01)
*F21V 21/34* (2006.01)
(Continued)

(52) U.S. Cl.
CPC ..... *F21K 9/17* (2013.01); *F21K 9/27* (2016.08); *F21K 9/275* (2016.08); *F21V 3/0436* (2013.01);
(Continued)

(58) Field of Classification Search
CPC ... F21K 9/17; F21K 9/27; F21K 9/275; F21V 3/0436; F21V 25/04; F21V 15/01; F21V 15/013; F21Y 2103/10
See application file for complete search history.

(56) References Cited

U.S. PATENT DOCUMENTS 2,454,049 A 11/1948 Floyd, Jr.
3,294,518 A 12/1966 Laseck
(Continued)

FOREIGN PATENT DOCUMENTS

CN 200965185 Y 10/2007
CN 101715265 A 5/2010
(Continued)

*Primary Examiner* — Alan Cariaso
(74) *Attorney, Agent, or Firm* — Im IP Law; C. Andrew Im

(57) ABSTRACT

An LED tube lamp includes a lamp tube, which includes a light transmissive portion, a reinforcing portion and an end cap, and an LED light assembly, which includes an LED light source and an LED light strip. The light transmissive portion is fixedly connected to the reinforcing portion. The reinforcing portion includes a platform and a bracing structure fixedly connected to the platform and holds the platform in place. The bracing structure is made from a material having a greater stiffness than the material from which the lamp tube is made. The LED light source is thermally and electrically connected to the LED light strip, which is in turn thermally connected to the reinforcing portion. The end cap is attached to an end of the lamp tube. The light transmissive portion and the reinforcing portion define a first line between them on a cross section of the lamp tube.

22 Claims, 27 Drawing Sheets

(30) Foreign Application Priority Data

| | | |
|---|---|---|
| May 19, 2015 | (CN) | 2015 1 0259151 |
| Jun. 12, 2015 | (CN) | 2015 1 0324394 |
| Jun. 26, 2015 | (CN) | 2015 1 0373492 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 14, 2015 | (CN) | 2015 1 0499512 |
| Sep. 2, 2015 | (CN) | 2015 1 0555543 |
| Oct. 29, 2015 | (CN) | 2015 1 0724263 |
| Dec. 4, 2015 | (CN) | 2015 1 0882517 |

(51) Int. Cl.

| | |
|---|---|
| ***F21V 3/04*** | (2018.01) |
| ***F21K 9/275*** | (2016.01) |
| ***F21V 25/04*** | (2006.01) |
| ***F21K 9/27*** | (2016.01) |
| *F21Y 103/10* | (2016.01) |
| *F21Y 115/10* | (2016.01) |

(52) U.S. Cl.

CPC ..... *F21V 25/04* (2013.01); *F21Y 2103/10* (2016.08); *F21Y 2115/10* (2016.08)

(56) References Cited

U.S. PATENT DOCUMENTS

| | | | | |
|---|---|---|---|---|
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 6,118,072 | A | 9/2000 | Scott | |
| 6,127,783 | A | 10/2000 | Pashley | |
| 6,186,649 | B1 | 2/2001 | Zou et al. | |
| 6,211,262 | B1 | 4/2001 | Mejiritski et al. | |
| 6,609,813 | B1 | 8/2003 | Showers | |
| 6,796,680 | B1 | 9/2004 | Showers | |
| 6,860,628 | B2 | 3/2005 | Robertson et al. | |
| 6,936,855 | B1 | 8/2005 | Harrah et al. | |
| 7,033,239 | B2 | 4/2006 | Cunkelman | |
| 7,067,032 | B1 | 6/2006 | Bremont et al. | |
| 7,594,738 | B1 | 9/2009 | Lin et al. | |
| 8,240,875 | B2 * | 8/2012 | Roberts | F21V 5/002 362/217.05 |
| 8,360,599 | B2 * | 1/2013 | Ivey | F21V 23/06 362/218 |
| 8,456,075 | B2 | 6/2013 | Axelsson | |
| 8,579,463 | B2 | 11/2013 | Clough | |
| 9,000,668 | B2 | 4/2015 | Qiu | |
| 9,335,008 | B2 | 5/2016 | Fujita et al. | |
| D761,216 | S | 7/2016 | Jiang | |
| 9,447,929 | B2 | 9/2016 | Jiang | |
| D768,891 | S | 10/2016 | Jiang et al. | |
| 9,611,984 | B2 | 4/2017 | Jiang et al. | |
| 9,618,166 | B2 | 4/2017 | Jiang et al. | |
| 9,618,168 | B1 | 4/2017 | Jiang et al. | |
| 9,625,129 | B2 | 4/2017 | Jiang et al. | |
| 9,625,137 | B2 | 4/2017 | Li et al. | |
| D797,323 | S | 9/2017 | Yang et al. | |
| 2002/0044456 | A1 | 4/2002 | Balestriero | |
| 2002/0176262 | A1 | 11/2002 | Tripathi | |
| 2003/0102819 | A1 | 6/2003 | Min | |
| 2003/0231485 | A1 | 12/2003 | Chien | |
| 2004/0095078 | A1 | 5/2004 | Leong | |
| 2004/0189218 | A1 | 9/2004 | Leong | |
| 2005/0128751 | A1 | 6/2005 | Roberge | |
| 2005/0162850 | A1 | 7/2005 | Luk | |
| 2005/0207166 | A1 | 9/2005 | Kan | |
| 2005/0213321 | A1 | 9/2005 | Lin | |
| 2007/0001709 | A1 | 1/2007 | Shen | |
| 2007/0145915 | A1 | 6/2007 | Roberge | |
| 2007/0210687 | A1 | 9/2007 | Axelsson | |
| 2007/0274084 | A1 | 11/2007 | Kan | |
| 2008/0030981 | A1 | 2/2008 | Mrakovich | |
| 2008/0192476 | A1 | 8/2008 | Hiratsuka | |
| 2008/0278941 | A1 | 11/2008 | Logan | |
| 2009/0161359 | A1 | 6/2009 | Siemiet | |
| 2010/0253226 | A1 | 10/2010 | Oki | |
| 2011/0038146 | A1 | 2/2011 | Chen | |
| 2011/0057572 | A1 | 3/2011 | Kit | |
| 2011/0090684 | A1 | 4/2011 | Logan | |
| 2011/0148313 | A1 | 6/2011 | Ramaker | |
| 2011/0216538 | A1 | 9/2011 | Logan | |
| 2012/0069556 | A1 | 3/2012 | Bertram | |
| 2012/0106157 | A1 | 5/2012 | Simon | |
| 2012/0153873 | A1 | 6/2012 | Hayashi | |
| 2013/0050998 | A1 | 2/2013 | Chu | |
| 2013/0170245 | A1 | 7/2013 | Hong | |
| 2013/0182425 | A1 | 7/2013 | Seki | |
| 2013/0200797 | A1 | 8/2013 | Timmermans | |
| 2014/0071667 | A1 | 3/2014 | Hayashi | |
| 2014/0153231 | A1 | 6/2014 | Bittmann | |
| 2014/0226320 | A1 | 8/2014 | Halliwell | |
| 2015/0009688 | A1 | 1/2015 | Timmermans | |
| 2015/0022999 | A1 | 1/2015 | Yu et al. | |
| 2016/0091147 | A1 | 3/2016 | Jiang et al. | |
| 2016/0091156 | A1 | 3/2016 | Li et al. | |
| 2016/0091179 | A1 | 3/2016 | Jiang et al. | |
| 2016/0102813 | A1 | 4/2016 | Ye et al. | |
| 2016/0178135 | A1 | 6/2016 | Xu et al. | |
| 2016/0178137 | A1 | 6/2016 | Jiang | |
| 2016/0178138 | A1 | 6/2016 | Jiang | |
| 2016/0198535 | A1 | 7/2016 | Ye et al. | |
| 2016/0212809 | A1 | 7/2016 | Xiong et al. | |
| 2016/0215936 | A1 | 7/2016 | Jiang | |
| 2016/0215937 | A1 | 7/2016 | Jiang | |
| 2016/0219658 | A1 | 7/2016 | Xiong et al. | |
| 2016/0219666 | A1 | 7/2016 | Xiong et al. | |
| 2016/0219672 | A1 | 7/2016 | Liu | |
| 2016/0229621 | A1 | 8/2016 | Jiang et al. | |
| 2016/0255694 | A1 | 9/2016 | Jiang et al. | |
| 2016/0255699 | A1 | 9/2016 | Ye et al. | |
| 2016/0270163 | A1 | 9/2016 | Hu et al. | |
| 2016/0270164 | A1 | 9/2016 | Xiong et al. | |
| 2016/0270165 | A1 | 9/2016 | Xiong et al. | |
| 2016/0270166 | A1 | 9/2016 | Xiong et al. | |
| 2016/0270173 | A1 | 9/2016 | Xiong | |
| 2016/0270184 | A1 | 9/2016 | Xiong et al. | |
| 2016/0290566 | A1 | 10/2016 | Jiang et al. | |
| 2016/0290567 | A1 | 10/2016 | Jiang et al. | |
| 2016/0290568 | A1 | 10/2016 | Jiang et al. | |
| 2016/0290569 | A1 | 10/2016 | Jiang et al. | |
| 2016/0290570 | A1 | 10/2016 | Jiang et al. | |
| 2016/0290598 | A1 | 10/2016 | Jiang | |
| 2016/0290609 | A1 | 10/2016 | Jiang et al. | |
| 2016/0295706 | A1 | 10/2016 | Jiang | |
| 2016/0309550 | A1 | 10/2016 | Xiong et al. | |
| 2016/0323948 | A1 | 11/2016 | Xiong et al. | |
| 2016/0341414 | A1 | 11/2016 | Jiang | |
| 2016/0356472 | A1 | 12/2016 | Liu et al. | |
| 2016/0381746 | A1 | 12/2016 | Ye et al. | |
| 2016/0381760 | A1 | 12/2016 | Xiong et al. | |
| 2017/0001793 | A1 | 1/2017 | Jiang et al. | |

FOREIGN PATENT DOCUMENTS

| | | | |
|---|---|---|---|
| CN | 102121690 | A | 7/2011 |
| CN | 102155642 | A | 8/2011 |
| CN | 202125774 | U | 1/2012 |
| CN | 102355780 | A | 2/2012 |
| CN | 102518972 | A | 6/2012 |
| CN | 202546330 | U | 11/2012 |
| CN | 102932997 | A | 2/2013 |
| CN | 203162856 | U | 8/2013 |
| CN | 203240337 | U | 10/2013 |
| CN | 203384716 | U | 1/2014 |
| CN | 203413396 | U | 1/2014 |
| CN | 203453866 | U | 2/2014 |
| CN | 204268162 | U | 4/2014 |
| CN | 203585876 | U | 5/2014 |
| CN | 203615110 | U | 5/2014 |
| CN | 203927469 | U | 11/2014 |

(56) References Cited

FOREIGN PATENT DOCUMENTS

| | | | |
|---|---|---|---|
| CN | 204300737 | U | 4/2015 |
| CN | 104595765 | A | 5/2015 |
| CN | 204420636 | U | 6/2015 |
| WO | 2011/132120 | A1 | 10/2011 |
| WO | 2013/125803 | A1 | 8/2013 |
| WO | 2013147504 | A1 | 10/2013 |
| WO | 2014/001475 | A1 | 1/2014 |
| WO | 2015/036478 | A1 | 3/2015 |

* cited by examiner

LED TUBE LAMP

RELATED APPLICATIONS

This is a continuation application of International Application PCT/CN2015/096501, with an international filing date of Dec. 5, 2015. The present application claims the benefit of the following Chinese Patent Applications: CN201410734425.5 filed Dec. 5, 2014; CN201510075925.7 filed Feb. 12, 2015; CN201510259151.3 filed May 19, 2015; CN201510324394.0 filed Jun. 12, 2015; CN201510373492.3 filed Jun. 26, 2015; CN201510448220.5 filed Jul. 27, 2015; CN 201510482944.1 filed Aug. 7, 2015; CN201510483475.5 filed Aug. 8, 2015; CN 201510499512.1 filed Aug. 14, 2015; CN201510555543.4 filed Sep. 2, 2015; CN 201510724263.1 filed Oct. 29, 2015; and CN201510882517.2 filed Dec. 4, 2015, each of which is incorporated herein by reference in its entirety.

FIELD OF THE INVENTION

The present invention relates to the features of LED incendiaries. More particularly, this invention describes various new and useful improvements for LED tube lamps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desirable illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Typical LED tube lamps have a variety of LED elements and driving circuits. The LED elements include LED chip-packaging elements, light diffusion elements, high efficient heat dissipating elements, light reflective boards and light diffusing boards. Heat generated by the LED elements and the driving elements is considerable and mainly dominates the illumination intensity such that the heat dissipation needs to be properly disposed to avoid rapid decrease of the luminance and the lifetime of the LED lamps. Problems including power loss, rapid light decay, and short lifetime due to poor heat dissipation are always the key factors in consideration of improving the performance of the LED illuminating system. It is therefore one of the important issues to solve the heat dissipation problem of the LED products.

Nowadays, most of the LED tube lamps use plastic tubes and metallic elements to dissipate heat from the LEDs. The metallic elements are usually exposed to the outside of the plastic tubes. This design improves heat dissipation but heightens the risk of electric shocks. The metallic elements may be disposed inside the plastic tubes, however the heat still remains inside the plastic tubes and deforms the plastic tubes. Deformation of the plastic tubes also occurs even when the elements to dissipate heat from the LEDs are not metallic.

The metallic elements disposed to dissipate heat from the LEDs may be made of aluminum. However, aluminum is too soft to sufficiently support the plastic tubes when the deformation of plastic tubes occurs due to the heat as far as the metallic elements disposed inside the plastic tubes are concerned.

As a result, the current related skills still could not be applied to deal with the above-mentioned worse heat conduction, poor heat dissipation, heat deformation, and electric shock defects. On the other hand, the LED tube lamp may be provided with power via two ends of the lamp and a user is easily to be electric shocked when one end of the lamp is already inserted into an terminal of a power supply while the other end is held by the user to reach the other terminal of the power supply. In view of these issues, the claimed invention and the preferred embodiments are proposed below.

OBJECT AND SUMMARY OF THE INVENTION

Therefore, it is an object of the claimed invention to provide a significantly improved LED tube lamp that dissipates heat more efficiently. It is a further object of the claimed invention to provide an LED tube lamp that is structurally stronger. It is yet another object of the claimed invention to provide an LED tube lamp that minimizes the risk of electric shocks.

In accordance with an exemplary embodiment of the claimed invention, the LED tube lamp comprises a lamp tube, which includes a light transmissive portion, a reinforcing portion and an end cap; and an LED light assembly, which includes an LED light source and an LED light strip. The light transmissive portion is fixedly connected to the reinforcing portion. The reinforcing portion includes a platform and a bracing structure. The bracing structure is fixedly connected to the platform and holds the platform in place. The bracing structure is made from a material having a greater stiffness than a material from which the light transmissive portion is made. The LED light source is thermally and electrically connected to the LED light strip, which is in turn thermally connected to the reinforcing portion. The end cap is attached to an end of the lamp tube. The light transmissive portion and the reinforcing portion define a first line between them on a cross section of the lamp tube. The lamp tube has a shape of a circular cylinder. A cross section of an inner surface of the lamp tube defines a hypothetical circle. A second line parallel to the first line on the cross section cuts the circle horizontally into two equal halves along a diameter of the circle. A cross section of the light transmissive portion defines an upper segment on the circle. A cross section of the reinforcing portion defines a lower segment on the circle. The bracing structure is made from one of metal, metal alloy and plastic. A ratio of a cross-sectional area of the bracing structure to a cross-sectional area of the lamp tube is from 1:3 to 1:30.

Referring to FIG. 2, in accordance with an exemplary embodiment of the claimed invention, the first line sits below the second line. The upper segment, which encompasses the light transmissive portion, has a greater area than the lower segment, which encompasses the reinforcing portion.

Referring to FIG. 34, in accordance with an exemplary embodiment of the claimed invention, the first line rises above the second line. The upper segment, which encompasses the light transmissive portion, has a smaller area than the lower segment, which encompasses the reinforcing portion.

Referring to FIG. 1, in accordance with an exemplary embodiment of the claimed invention, the first line sits exactly on the second line. The upper segment, which encompasses the light transmissive portion, has a same area than the lower segment, which encompasses the reinforcing portion.

In accordance with an exemplary embodiment of the claimed invention, the bracing structure includes a first metallic object and a second metallic object. The second metallic object is made from a material having a greater stiffness than a material from which the first metallic object is made. A ratio of a cross-sectional area of the second metallic object to a cross-sectional area of the first metallic object is from 0.1:1 to 10:1.

In accordance with an exemplary embodiment of the claimed invention, the lamp tube further includes a pair of protruding bars. The protruding bar extends in an axial direction along an inner surface of the lamp tube and is configured to form a guiding channel inside the lamp tube. The reinforcing portion is connected to the lamp tube by sliding the reinforcing portion into the guiding channel. The reinforcing portion is disposed entirely inside the lamp tube. The reinforcing portion rests on an inner surface of the lamp tube along a substantially uninterrupted interface.

In accordance with an exemplary embodiment of the claimed invention, the bracing structure includes one of a vertical rib, a horizontal rib, a curvilinear rib and a combination of ribs selected from the above.

In accordance with an exemplary embodiment of the claimed invention, the lamp tube further includes a ridge. The ridge is an elongated structure extending in an axial direction along an inner surface of the lamp tube.

In accordance with an exemplary embodiment of the claimed invention, the ridge is broken at intervals.

In accordance with an exemplary embodiment of the claimed invention, the lamp tube further includes a maintaining stick. The ridge is a hollow structure. The maintaining stick fills up the space inside the ridge.

In accordance with an exemplary embodiment of the claimed invention, a compartment is defined by the platform and a rib. The ridge is disposed inside the compartment.

In accordance with an exemplary embodiment of the claimed invention, a compartment is defined by the reinforcing structure and an inner surface of the lamp tube. The ridge is disposed inside the compartment.

In accordance with an exemplary embodiment of the claimed invention, the second line passes through the ridge.

In accordance with an exemplary embodiment of the claimed invention, the bracing structure includes a curvilinear rib. A cross section of the curvilinear rib defines a lower arc on the circle.

In accordance with an exemplary embodiment of the claimed invention, the bracing structure further includes a vertical rib. A cross section of the platform and the vertical rib approximates a cross section of a hypothetical T-beam. All three ends of the T-beam sit on the lower arc.

In accordance with an exemplary embodiment of the claimed invention, an outer surface of the reinforcing portion forms an outer surface of the lamp tube.

In accordance with an exemplary embodiment of the claimed invention, the LED light strip forms the platform.

In accordance with an exemplary embodiment of the claimed invention, the lamp tube, which includes a light transmissive portion, a reinforcing portion, a ridge and an end cap; and an LED light assembly, which includes an LED light source and an LED light strip. The light transmissive portion is fixedly connected to the reinforcing portion. The reinforcing portion includes a platform and a bracing structure. The LED light strip forms the platform. The bracing structure is fixedly connected to the platform and holds the platform in place. The bracing structure is made from a material having a greater stiffness than a material from which the light transmissive portion is made. The LED light source is thermally and electrically connected to the LED light strip, which is in turn thermally connected to the reinforcing portion. The end cap is attached to an end of the lamp tube. The light transmissive portion and the reinforcing portion define a first line between them on a cross section of the lamp tube. The lamp tube has a shape of a circular cylinder. A cross section of an inner surface of the lamp tube defines a hypothetical circle. A second line parallel to the first line on the cross section cuts the circle horizontally into two equal halves along a diameter of the circle. A cross section of the light transmissive portion defines an upper segment on the circle. A cross section of the reinforcing portion defines a lower segment on the circle. The bracing structure includes a curvilinear rib. A cross section of the curvilinear rib defines a lower arc on the circle. An outer surface of the reinforcing portion forms an outer surface of the lamp tube. The ridge is an elongated structure extending in an axial direction along an inner surface of the lamp tube. The bracing structure is made from one of metal, metal alloy and plastic. A ratio of a cross-sectional area of the bracing structure to a cross-sectional area of the lamp tube is from 1:3 to 1:30.

Various other objects, advantages and features of the present invention will become readily apparent from the ensuing detailed description, and the novel features will be particularly pointed out in the appended claims.

BRIEF DESCRIPTION OF THE DRAWINGS

The following detailed descriptions, given by way of example, and not intended to limit the present invention solely thereto, will be best be understood in conjunction with the accompanying figures.

DETAILED DESCRIPTION OF THE EMBODIMENTS

Figure 1:
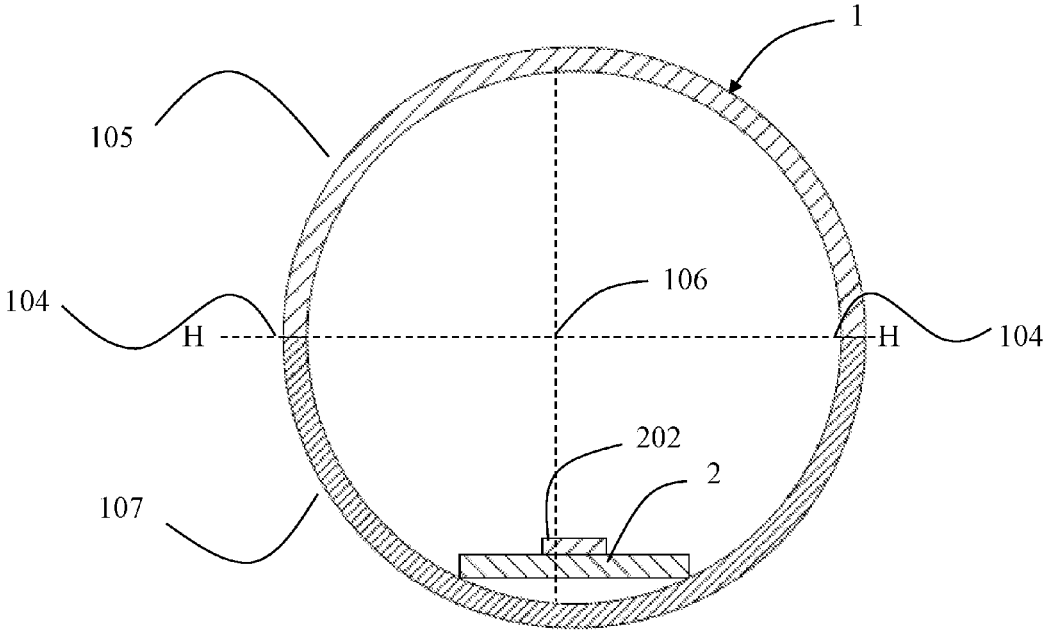
FIG. 1 is a cross-sectional view of the LED tube lamp with a light transmissive portion and a reinforcing portion in accordance with an exemplary embodiment of the claimed invention.

Referring to FIG. 1, in accordance with an exemplary embodiment of the claimed invention, the LED tube lamp comprises a lamp tube 1 and an LED light assembly. The lamp tube 1 includes a light transmissive portion 105 and a reinforcing portion 107. The reinforcing portion 107 is fixedly connected to the light transmissive portion 105.

The LED light assembly is disposed inside the lamp tube 1 and includes an LED light source 202 and an LED light strip 2. The LED light source 202 is thermally and electrically connected to the LED light strip 2, which is in turn thermally connected to the reinforcing portion 107. Heat generated by the LED light source 202 is first transmitted to the LED light strip 2 and then to the reinforcing portion 107 before egressing the lamp tube 1. Thermal connection is achieved with thermally conductive tapes or conventional mechanical fasteners such as screws aided by thermal grease to eliminate air gaps from interface areas.

Typically, the lamp tube 1 has a shape of an elongated cylinder, which is a straight structure. However, the lamp tube 1 can take any curved structure such as a ring or a horseshoe. The cross section of the lamp tube 1 defines, typically, a circle, or not as typically, an ellipse or a polygon. Alternatively, the cross section of the lamp tube 1 takes an irregular shape depending on the shapes of, respectively, the light transmissive portion 105 and the reinforcing portion 107 and on the manner the two portions interconnect to form the lamp tube 1.

The lamp tube 1 is a glass tube, a plastic tube or a tube made of any other suitable material or combination of materials. A plastic lamp tube is made from light transmissive plastic, thermally conductive plastic or a combination of both. The light transmissive plastic is one of translucent polymer matrices such as polymethyl methacrylate, polycarbonate, polystyrene, poly(styrene-co-methyl methacrylate) and a mixture thereof. Optionally, the strength and elasticity of thermally conductive plastic is enhanced by bonding a plastic matrix with glass fibers. When a lamp tube employs a combination of light transmissive plastic and thermally conductive plastic, does in the combination. In an embodiment, an outer shell of lamp tube includes a plurality of layers made from distinct materials. For example, the lamp tube includes a plastic tube coaxially sheathed by a glass tube.

In an embodiment, the light transmissive portion 105 is made from light transmissive plastic. The reinforcing portion is 107 made from thermally conductive plastic. Injection molding is used for producing the light transmissive portion 105 in a first piece and for producing the reinforcing portion 107 in a separate second piece. The first piece and the second piece are configured to be clipped together, buckled together, glued together or otherwise fixedly interconnect to form the lamp tube 1. Alternatively, injection molding is used for producing the lamp tube 1, which includes the light transmissive portion 105 and the reinforcing portion 107, in an integral piece by feeding two types of plastic materials into a molding process. In an alternative embodiment, the reinforcing portion is made of metal having good thermal conductivity such as aluminum alloy and copper alloy.

Respective shapes of the light transmissive portion 105 and the reinforcing portion 107, how the two portions 105, 107 interconnect to form the lamp tube 1 and, particularly, the respective proportions of the two portions 105, 107 in the lamp tube depend on a desired totality of considerations such as field angle, heat dissipation efficiency and structural strength. A wider field angle—potentially at the expense of heat dissipation capability and structural strength—is achieved when the proportion of the light transmissive portion increases 105 in relation to that of the reinforcing portion 107. By contrast, the lamp tube benefits from an increased proportion of the reinforcing portion 107 in relation to that of the light transmissive portion in such ways as better heat dissipation and rigidity but potentially loses field angle.

In some embodiments, the reinforcing portion 107 includes a plurality of protruding parts. In other embodiments, a plurality of protruding parts are disposed on the surface of the LED light strip 2 that is not covered by the LED light assembly. Like fins on a heatsink, the protruding part boosts heat dissipation by increasing the surface area of the reinforcing portion 107 and the LED light strip 2. The protruding parts are disposed equidistantly, or alternatively, not equidistantly.

Staying on FIG. 1, the lamp tube 1 has a shape of a circular cylinder. Thus, a cross section of the lamp tube 1 defines a hypothetical circle. A line H-H cuts the circle horizontally into two equal halves along a diameter of the circle. A cross section of the light transmissive portion 105 defines an upper segment on the circle. A cross section of the reinforcing portion 107 defines a lower segment on the circle. A dividing line 104 parallel to the line H-H is shared by the two segments. In the embodiment, the dividing line 104 sits exactly on the line H-H. Consequently, the area of the upper segment is the same as that of the lower segment. In other words, the cross section of the light transmissive portion 105 has a same area as that of the reinforcing portion 107.

In an alternative embodiment, the dividing line 104 is spaced apart from the line H-H. For example, when the dividing line 104 is below the line H-H, the upper segment, which encompasses the light transmissive portion, has a greater area than the lower segment, which encompasses the reinforcing portion. The lamp tube, which includes an enlarged light transmissive portion, is thus configured to achieve a field angle wider than 180 degrees; however, other things equal, the lamp tube surrenders some heat dissipation capability, structural strength or both due to a diminished reinforcing portion 107. By contrast, the lamp tube 1 has an enlarged reinforcing portion 107 and a diminished light transmissive portion 105 if the dividing line rises above the line H-H. Other things equal, the lamp tube 1, now having an enlarged reinforcing portion 107, is configured to exhibit higher heat dissipation capability, structural strength or both; however, the field angle of the lamp tube 1 will dwindle due to diminished dimensions of the light transmissive portion 105.

The LED tube lamp is configured to convert bright spots coming from the LED light source into an evenly distributed luminous output. In an embodiment, a light diffusion layer is disposed on an inner surface of the lamp tube 1 or an outer surface of the lamp tube 1. In another embodiment, a diffusion laminate is disposed over the LED light source 202. In yet another embodiment, the lamp tube 1 has a glossy outer surface and a frosted inner surface. The inner surface is rougher than the outer surface. The roughness Ra of the inner surface is, preferably, from 0.1 to 40 μm, and most preferably, from 1 to 20 μm. Controlled roughness of the surface is obtained mechanically by a cutter grinding against a workpiece, deformation on a surface of a workpiece being cut off or high frequency vibration in the manufacturing system. Alternatively, roughness is obtained chemically by etching a surface. Depending on the luminous effect the lamp tube 1 is designed to produce, a suitable combination of amplitude and frequency of a roughened surface is provided by a matching combination of workpiece and finishing technique.

In alternative embodiment, the diffusion layer is in form of an optical diffusion coating, which is composed of any one of calcium carbonate, halogen calcium phosphate and aluminum oxide, or any combination thereof. When the optical diffusion coating is made from a calcium carbonate with suitable solution, an excellent light diffusion effect and transmittance to exceed 90% can be obtained.

In alternative embodiment, the diffusion layer is in form of an optical diffusion coating, which is composed of any one of calcium carbonate, halogen calcium phosphate and aluminum oxide, or any combination thereof. When the optical diffusion coating is made from a calcium carbonate with suitable solution, an excellent light diffusion effect and transmittance to exceed 90% can be obtained.

In the embodiment, the composition of the diffusion layer in form of the optical diffusion coating includes calcium carbonate, strontium phosphate (e.g., CMS-5000, white powder), thickener, and a ceramic activated carbon (e.g., ceramic activated carbon SW-C, which is a colorless liquid). Specifically, such an optical diffusion coating on the inner circumferential surface of the glass tube has an average thickness ranging between about 20 to about 30 μm. A light transmittance of the diffusion layer using this optical diffusion coating is about 90%. Generally speaking, the light transmittance of the diffusion layer ranges from 85% to 96%. In addition, this diffusion layer can also provide electrical isolation for reducing risk of electric shock to a user upon breakage of the lamp tube 1. Furthermore, the diffusion layer provides an improved illumination distribution uniformity of the light outputted by the LED light sources 202 such that the light can illuminate the back of the light sources 202 and the side edges of the bendable circuit sheet so as to avoid the formation of dark regions inside the lamp tube 1 and improve the illumination comfort. In another possible embodiment, the light transmittance of the diffusion layer can be 92% to 94% while the thickness ranges from about 200 to about 300 μm.

In another embodiment, the optical diffusion coating can also be made of a mixture including calcium carbonate-based substance, some reflective substances like strontium phosphate or barium sulfate, a thickening agent, ceramic activated carbon, and deionized water. The mixture is coated on the inner circumferential surface of the glass tube and has an average thickness ranging between about 20 to about 30 μm. In view of the diffusion phenomena in microscopic terms, light is reflected by particles. The particle size of the reflective substance such as strontium phosphate or barium sulfate will be much larger than the particle size of the calcium carbonate. Therefore, adding a small amount of reflective substance in the optical diffusion coating can effectively increase the diffusion effect of light.

In other embodiments, halogen calcium phosphate or aluminum oxide can also serve as the main material for forming the diffusion layer. The particle size of the calcium carbonate is about 2 to 4 μm, while the particle size of the halogen calcium phosphate and aluminum oxide are about 4 to 6 μm and 1 to 2 μm, respectively. When the light transmittance is required to be 85% to 92%, the required average thickness for the optical diffusion coating mainly having the calcium carbonate is about 20 to about 30 μm, while the required average thickness for the optical diffusion coating mainly having the halogen calcium phosphate may be about 25 to about 35 μm, the required average thickness for the optical diffusion coating mainly having the aluminum oxide may be about 10 to about 15 μm. However, when the required light transmittance is up to 92% and even higher, the optical diffusion coating mainly having the calcium carbonate, the halogen calcium phosphate, or the aluminum oxide must be thinner.

The main material and the corresponding thickness of the optical diffusion coating can be decided according to the place for which the lamp tube 1 is used and the light transmittance required. It is to be noted that the higher the light transmittance of the diffusion layer is required, the more apparent the grainy visual of the light sources is.

In an embodiment, the LED tube lamp is configured to reduce internal reflectance by applying a layer of anti-reflection coating to an inner surface of the lamp tube 1. The coating has an upper boundary, which divides the inner surface of the lamp tube and the anti-reflection coating, and a lower boundary, which divides the anti-reflection coating and the air in the lamp tube 1. Light waves reflected by the upper and lower boundaries of the coating interfere with one another to reduce reflectance. The coating is made from a material with a refractive index of a square root of the refractive index of the light transmissive portion 105 of the lamp tube 1 by vacuum deposition. Tolerance of the coating's refractive index is ±20%. The thickness of the coating is chosen to produce destructive interference in the light reflected from the interfaces and constructive interference in the corresponding transmitted light. In an improved embodiment, reflectance is further reduced by using alternating layers of a low-index coating and a higher-index coating. The multi-layer structure is designed to, when setting parameters such as combination and permutation of layers, thickness of a layer, refractive index of the material, give low reflectivity over a broad band that covers at least 60%, or preferably, 80% of the wavelength range beaming from the LED light source 202. In some embodiments, three successive layers of anti-reflection coatings are applied to an inner surface of the lamp tube 1 to obtain low reflectivity over a wide range of frequencies. The thicknesses of the coatings are chosen to give the coatings optical depths of, respectively, one half, one quarter and one half of the wavelength range coming from the LED light source 202. Dimensional tolerance for the thickness of the coating is set at ±20%.

Figure 2:
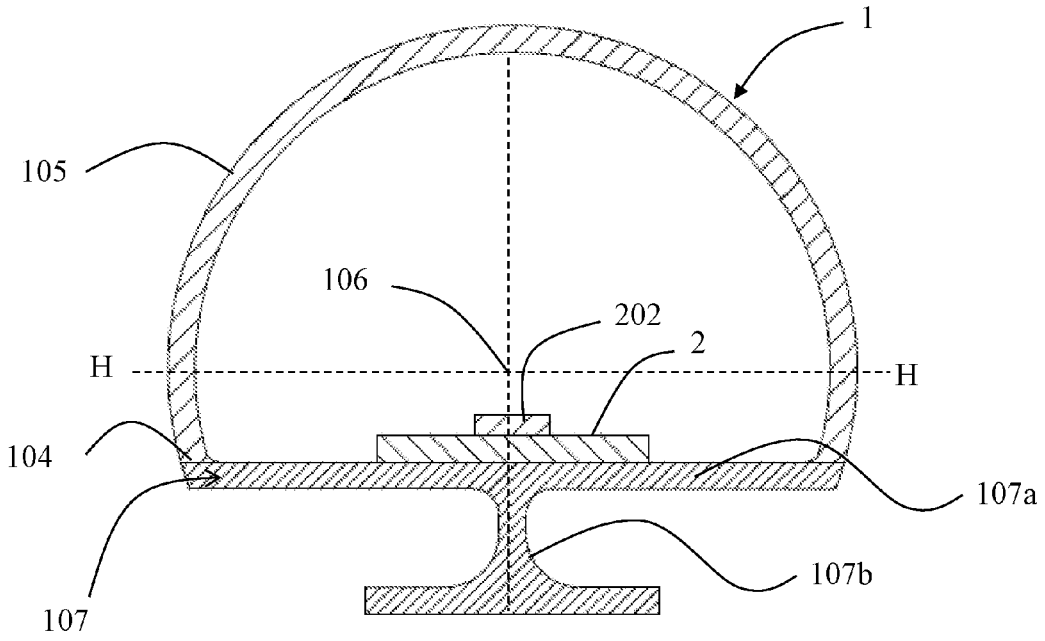
FIG. 2 is a cross-sectional view of the LED tube lamp with a bracing structure in accordance with an exemplary embodiment of the claimed invention.

Turning to FIG. 2, in accordance with an exemplary embodiment of the claimed invention, the cross section of the lamp tube 1, unlike that of the cylindrical lamp tube 1 in FIG. 1, approximates an arc sitting on a flange of an I-beam. The lamp tube 1 includes a light transmissive portion 105 and a reinforcing portion 107. A cross section of the light transmissive portion 105 defines an upper segment on a hypothetical circle. A line H-H cuts the circle horizontally into two equal halves along a diameter of the circle. The reinforcing portion 107 includes a platform 107*a* and a bracing structure 107*b*. The platform 107*a* has an upper surface and a lower surface. The LED light assembly is disposed on the upper surface of the platform 107*a*. The bracing structure 107*b* is fixedly connected to the platform 107*a* and holds the platform 107*a* in place. The bracing structure 107*b* includes a horizontal rib, a vertical rib, a curvilinear rib or a combination of ribs selected from the above. The dimensions of the platform 107*a*, the horizontal rib and the vertical rib, their quantities and the manner they interconnect depend on a desired totality of considerations such as heat dissipation efficiency and structural strength. In the embodiment, the cross section of the reinforcing portion 107 approximates that of an I-beam. The platform 107*a*, the vertical rib and the horizontal rib correspond to, respectively, the upper flange, the web and the bottom flange of the I-beam. In other words, the bracing structure 107*b* includes exactly one vertical rib and exactly one horizontal rib.

A dividing line 104 parallel to the line H-H is shared by the upper segment and the upper flange. In the embodiment, the dividing line sits below the line H-H. Consequently, the upper segment constitutes the majority of the hypothetical circle. The light transmissive portion 105 is thus configured to generate a field angle wider than 180 degrees. In an alternative embodiment, the dividing line sits on or above the line H-H. For example, when the dividing line rises above the line H-H, the upper segment, which encompasses the light transmissive portion, now constitutes less than half of the hypothetical circle. The lamp tube 1, which has an enlarged reinforcing portion 107, is thus configured for better heat dissipation and structural strength; however, other things equal, the lamp tube 1 loses some luminous filed due to a diminished light transmissive portion 105.

In an embodiment, a surface on which the LED light assembly sits—e.g. the upper surface of the platform—is configured to further reflect the light reflected from the inner surface of the lamp tube 1. The surface on which the LED light assembly sits is coated with a reflective layer. Alternatively, the surface is finished to exhibit a reflectance of 80 to 95%, or preferably, 85 to 90%. Finishing is performed mechanically, chemically or by fluid jet. Mechanical finishing buffs a surface by removing peaks from the surface with an abrasive stick, a wool polishing wheel or a sandpaper. A surface treated this way has a roughness Ra as low as 0.008 to 1 Chemical finishing works by dissolving peaks of a surface faster than troughs of the surface with a chemical agent. Fluid jet finishing uses a high-speed stream of slurry to accurately remove nanometers of material from a surface. The slurry is prepared by adding particles such as silicon carbide powder to a fluid capable of being pumped under relatively low pressure.

Figure 3:
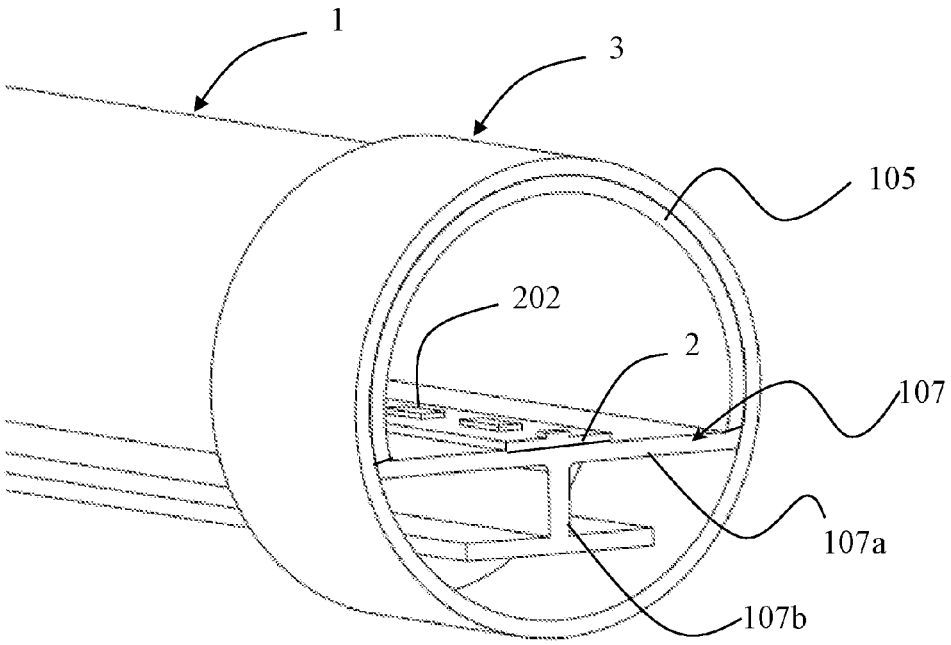
FIG. 3 is a perspective view of the LED tube lamp schematically illustrating the bracing structure shown in FIG. 2.

Turning to FIG. 3, in accordance with an exemplary embodiment of the claimed invention, the LED tube lamp further comprises an end cap 3, which is fixedly connected to an end of the lamp tube 1. The end cap 3 is made from plastic, metal or a combination of both. The end cap 3 and the lamp tube 1 are latched together, buckled together or otherwise mechanically fastened to one another. Alternatively, the two parts are glued together with hot-melt adhesive, e.g. a silicone matrix with a thermal conductivity of at least 0.7 $Wm^{-1}K^{-1}$.

Typically, the end cap 3 has a shape of a cylinder. The cross section of the end cap 3 thus defines a circle. Alternatively, the cross section of the end cap 3 takes an irregular shape depending on the shapes of, respectively, the light transmissive portion and the reinforcing portion and on the manner the two portions and the end cap 3 interconnect to form the LED tube lamp. Regardless of the shape of the end cap 3, the cross section of the end cap 3 encloses all or only a part of the cross section of the reinforcing portion 107 of the lamp tube 1. In the embodiment shown in FIG. 3, the end cap 3 defines a circular cylinder whose cross section encloses, entirely, the cross sections of, respectively, the light transmissive portion 105 and the reinforcing portion 107. The cross section of the lamp tube 1 approximates a segment, defined by the light transmissive portion 105, sitting on an upper flange of a hypothetical I-beam, defined by the reinforcing portion 107. A cross section of an inner surface of the end cap 3 defines a hypothetical circle. The hypothetical circle shares a same arc of the hypothetical segment defined by an outer surface of the light transmissive portion 105. The I-beam is enclosed, entirely, by the hypothetical circle.

Figure 4:
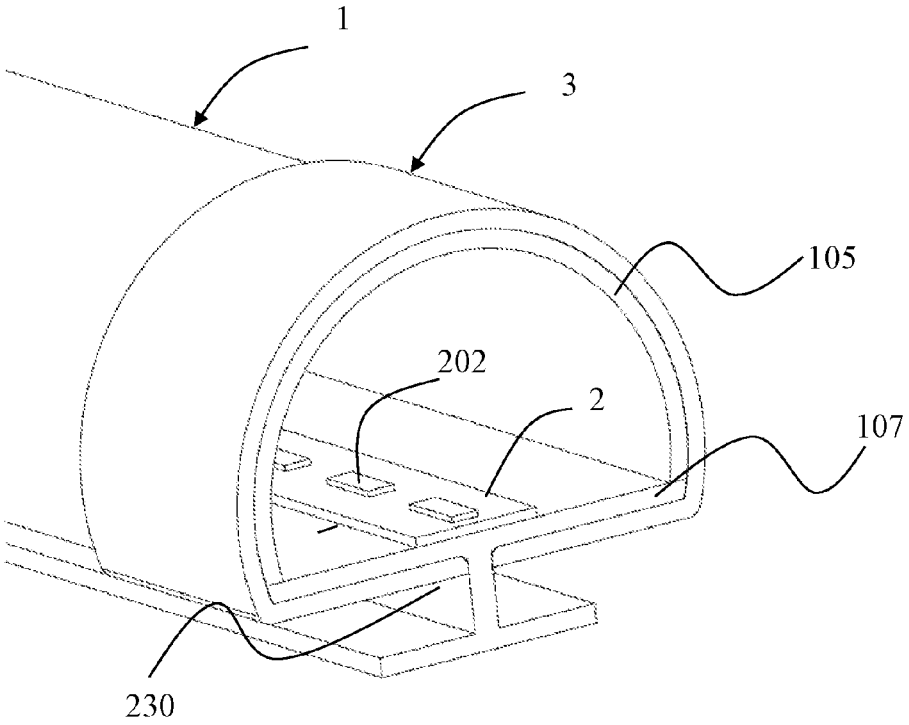
FIG. 4 is a perspective view of the LED tube lamp with a non-circular end cap in accordance with an exemplary embodiment of the claimed invention.

In an alternative embodiment shown in FIG. 4, the cross section of the end cap 3 encloses all of the cross section of the light transmissive portion 105 but only a part of that of the reinforcing portion 107. A cross section of the inner surface of the end cap 3 defines a same hypothetical segment defined by an outer surface of the light transmissive portion 105. However, only the upper flange of the hypothetical I-beam is enclosed by the hypothetical segment, but the lower flange and the web are not.

In some embodiments, an end of the LED light assembly extends to the end cap 3 as shown in FIGS. 3 and 4. In other embodiments, an end of the LED light assembly recedes from the end cap 3.

The bracing structure 107*b* may is made from a metallic material or plastic material. The metallic material is a pure metal, an alloy or a combination of pure metal and alloy having differentiated stiffness. Similarly, the plastic material is a single type of plastic or a combination of plastic materials having differentiated stiffness. Specifically, the plastic lamp tube 1 may include only one bracing structure with one stiffness or two bracing structures with various stiffness.

When only one bracing structure is adopted, the material of the only one bracing structure may be metal, metal alloy, or plastic, and the ratio of the cross-sectional area of the bracing structure to the cross-sectional area of the lamp tube 1 is from 1:3 to 1:30, or most preferably, from 1:5 to 1:10.

When more than one bracing structures with different stiffness are adopted, each of the bracing structures may be made of metal, metal alloy, or plastic. In one embodiment, when two bracing structures with different stiffness are adopted, the ratio of the cross-sectional area of the bracing structure with larger stiffness to the cross-sectional area of the other bracing structure is from 0.001:1 to 100:1, and the ratio of the cross-sectional area of the bracing structure with larger stiffness to the cross-sectional area of the lamp tube 1 is from 1:20 to 1:300.

In view of the bracing structure made of metal, the cross-section of the lamp tube 1 vertically cut by a hypothetical plane shows that the hypothetical plane may include the following 1. a lamp tube made of plastic, a first bracing structure made of a metal with a first stiffness, and a second bracing structure, such as a maintaining stick, made of a metal with a second stiffness different from the first stiffness; 2. a lamp tube made of plastic and a single bracing structure made of metal and/or metal alloy; or 3. a lamp tube made of plastic, a first bracing structure made of metal, and a second bracing structure, such as a maintaining stick, made of metal alloy. Similarly, various plastics with different stiffness may be used to serve as the bracing structures mentioned above according to embodiments of the present invention. As long as the materials for the used bracing structures have different stiffness, the materials are not limited. Thus, metal or metal alloy and plastic could also be served as materials for different bracing structures without departing from the spirit of the present invention. Additionally, the bracing structure is made from a material having a greater stiffness than a material from which the light transmissive portion is made.

In some embodiments, the lamp tube includes a first end cap fixedly connecting to a first end of the lamp tube and a second end cap fixedly connecting to a second end of the lamp tube. The first end cap is dimensionally larger—e.g. from 20% to 70% larger—than the second end cap.

Figure 5:
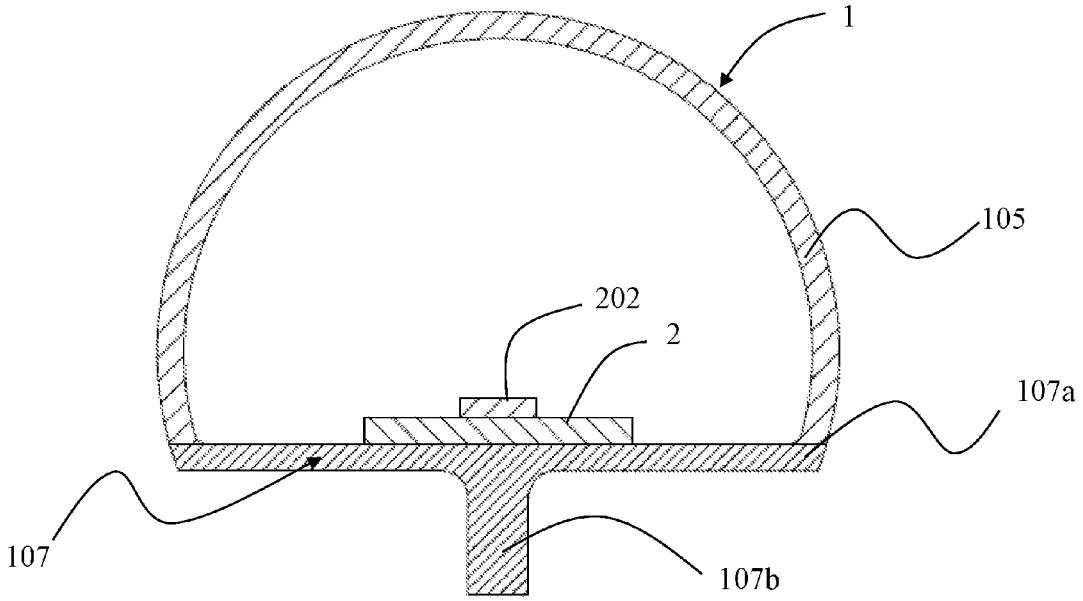
FIG. 5 is a cross-sectional view illustrating a vertical rib of the lamp tube in accordance with an exemplary embodiment of the claimed invention.

Shifting to FIG. 5, in accordance with an exemplary embodiment of the claimed invention, the cross section of the lamp tube 1 approximates an arc sitting on a flange of a hypothetical T-beam. The cross section of the reinforcing portion 107 approximates that of the T-beam. The platform 107*a* and the vertical rib correspond to, respectively, the flange and the web of the T-beam. In other words, the bracing structure 107*b* includes exactly one vertical rib but no horizontal rib. When the cross section of the end cap 3 encloses, entirely, the cross sections of, respectively, the light transmissive portion 105 and the reinforcing portion 107, other things equal, the vertical rib in a T-beam structure (FIG. 5) has a greater length than the vertical rib in an I-beam structure (FIG. 3).

Figure 6:
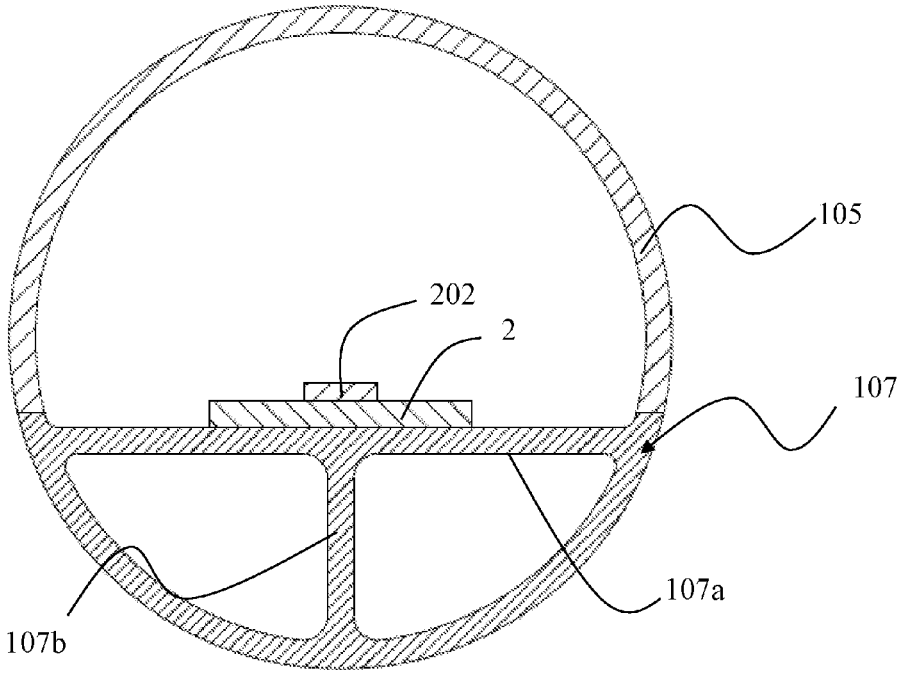
FIG. 6 is a cross-sectional view illustrating the bracing structure of the lamp tube in accordance with an exemplary embodiment of the claimed invention.

Turning to FIG. 6, in accordance with an exemplary embodiment of the claimed invention, the bracing structure 107*b* includes a vertical rib and a curvilinear rib but no horizontal rib. The cross section of the lamp tube 1 defines a hypothetical circle. A cross section of the light transmissive portion 105 defines an upper arc on the circle. A cross section of the curvilinear rib defines a lower arc on the circle. A cross section of the platform 107*a* and the vertical rib approximates that of a hypothetical T-beam. All three ends of the T-beam sit on the lower arc. The ratio of the length of the vertical rib to the diameter of the lamp tube 1 depends on a desired totality of considerations such as field angle, heatsinking efficiency and structural strength. Preferably, the ratio is from 1:1.2 to 1:30, or most preferably, from 1:3 to 1:10.

Figure 7:
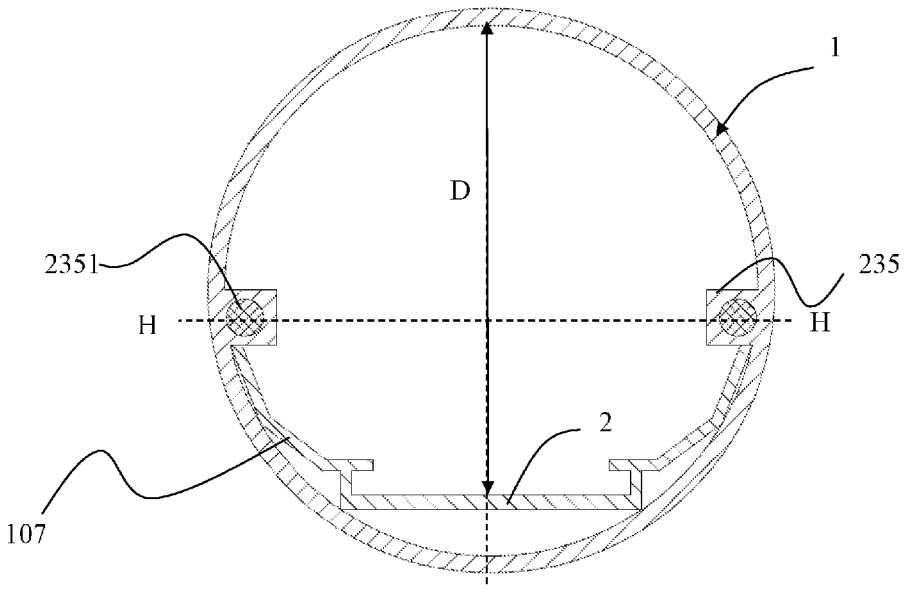
FIG. 7 is a cross-sectional view illustrating a ridge, which extends in an axial direction along an inner surface of the lamp tube, in accordance with an exemplary embodiment of the claimed invention.

Turing to FIG. 7, in accordance with an exemplary embodiment of the claimed invention, the lamp tube 1 further includes a ridge 235. The ridge 235 extends in an axial direction along an inner surface of the lamp tube 1. The ridge 235 is an elongated hollow structure unbroken from end to end, or alternatively, broken at intervals. Injection molding is used for producing the reinforcing portion 107 and the ridge 235 in an integral piece. The position of the ridge 235 in relation to the line H-H bisecting the hypothetical circle defined by the lamp tube 1 depends on, as elaborated earlier, a desired totality of considerations such as field angle, heatsink efficiency and structural strength.

In an embodiment, the lamp tube 1 further includes a ridge 235 and a maintaining stick 2351. The maintaining stick 2351 is, likewise, an elongated structure, which is unbroken from end to end, or alternatively, broken at intervals, and which fills up the space inside the ridge 235. The maintaining stick 2351 is made of thermally conductive plastic, or alternatively, metal. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. The material from which the maintaining stick 2351 is made is chosen to provide the LED tube lamp with a combination of heat dissipation capability and structural strength that is otherwise absent from other parts of the lamp tube 1. In an embodiment, the maintaining stick 2351 is made from a different material than a material from which the LED light strip 2 or the reinforcing portion 107 is made. For example, when the LED light strip 2 or the reinforcing portion 107 of the lamp tube 1 is made from a metal having superior heat dissipation capability but insufficient stiffness, e.g. aluminum panel, the maintaining stick 2351 is made from a metal stiffer than aluminum to supply more structural strength. The ratio of the volume of heatsinking-oriented metal to the volume of stiffness-oriented metal in a lamp tube 1 is from 0.001:1 to 100:1, or most preferably, from 0.1:1 to 10:1. The ratio of the cross-sectional area of the maintaining stick 2351 to that of the lamp tube 1 is from 1:20 to 1:100, or most preferably, from 1:50 to 1:100.

In some embodiments, the lamp tube 1 includes a light transmissive portion and a reinforcing portion. In other embodiments, a ridge is substituted for the reinforcing portion. Thus, in these embodiment, the lamp tube 1 includes a light transmissive portion and a ridge, but no reinforcing portion. In an improved embodiment, the lamp tube 1 further includes a maintaining stick that fills up the space inside the ridge.

The outer surface of the reinforcing portion forms an outer surface of the lamp tube 1, as the embodiments in FIGS. 1-6. Alternatively, the outer surface of the reinforcing portion forms none of the outer surface of the lamp tube, as the embodiments in FIGS. 7-11. Where the reinforcing portion 107 is disposed entirely inside the lamp tube 1, the reinforcing portion 107 rests on the inner surface of the lamp tube 1 along a substantially uninterrupted interface, as the embodiment in FIG. 8; or alternatively, along an interrupted interface, as the embodiments in FIGS. 7, 9-11.

Focusing on FIG. 7, in accordance with an exemplary embodiment of the claimed invention, a first compartment is defined by the reinforcing portion 107 and the inner surface of the lamp tube 1. A second compartment is defined by the LED light strip 2 and the inner surface of the lamp tube 1. Likewise, in FIG. 8, a compartment is defined by the platform 231, the vertical rib 233 and the curvilinear rib 232. In some embodiments, a ridge is disposed inside the compartment for great structural strength. In other embodiments, a maintaining stick fills up the space inside the hollow structure of the ridge.

The length of the reinforcing portion, on which the LED light assembly is disposed, in the vertical direction in relation to the diameter of the lamp tube depends on the field angle the lamp tube is designed to produce. In the embodiment shown in FIG. 7, the ratio of the distance (D) between the LED light assembly and the dome of the lamp tube 1 to the diameter of the lamp tube 1 is from 0.25 to 0.9, or most preferably, from 0.33 to 0.75.

Figure 8:
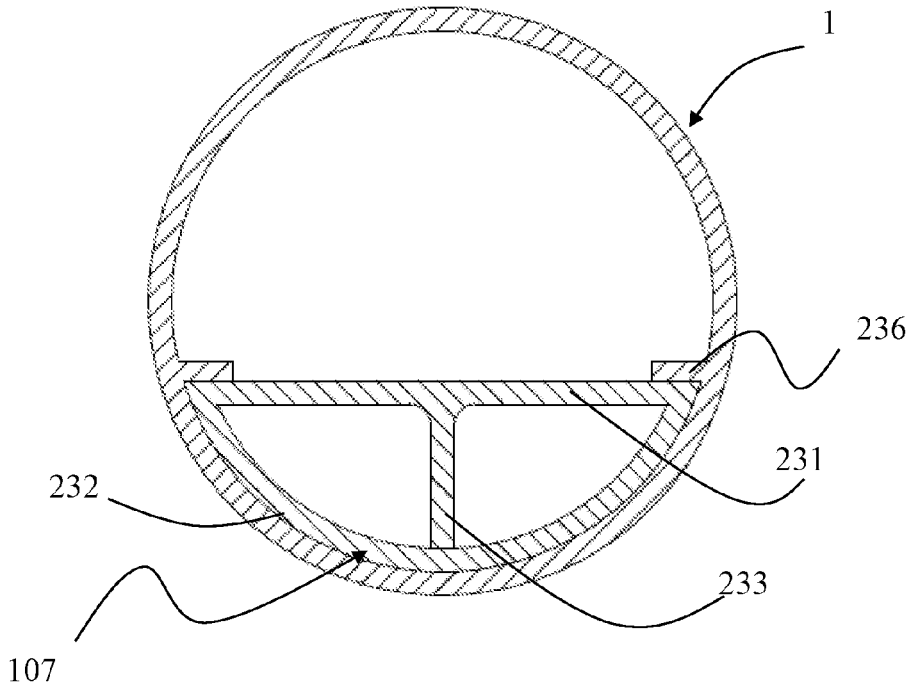
FIG. 8 is a cross-sectional view illustrating a compartment, which is defined by the bracing structure of the lamp tube, in accordance with an exemplary embodiment of the claimed invention.

Turning to FIG. 8, in accordance with an exemplary embodiment of the claimed invention, the lamp tube further includes a pair of protruding bars 236. The protruding bar 236 extends in an axial direction along an inner surface of the lamp tube 1 and is configured to form a guiding channel inside the lamp tube 1. The reinforcing portion 107 is connected to the lamp tube 1 by sliding the reinforcing portion 107 into the guiding channel. In the embodiment, a cross section of an inner surface of the lamp tube 1 defines a hypothetical circle. A cross section of the curvilinear rib 232 defines a lower arc on the circle. A cross section of the platform 231 and the vertical rib 233 approximates that of a hypothetical T-beam. All three ends of the T-beam sit on the lower arc. The pair of protruding bars 236 and the inner surface of the lamp tube 1 form the guiding channel in the lamp tube 1. The cross section of the guiding channel is defined by the flange of the T-beam and the lower arc. The reinforcing portion 107 is thus configured to fit snugly into the guiding channel.

Figure 9:
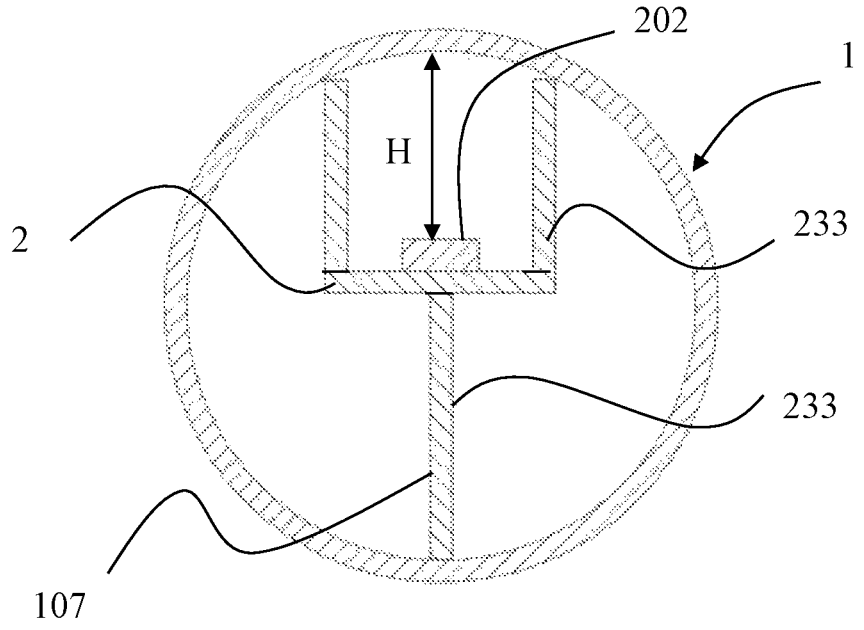
FIG. 9 is a cross-sectional view illustrating the bracing structure of the lamp tube in accordance with an exemplary embodiment of the claimed invention.
Figure 10:
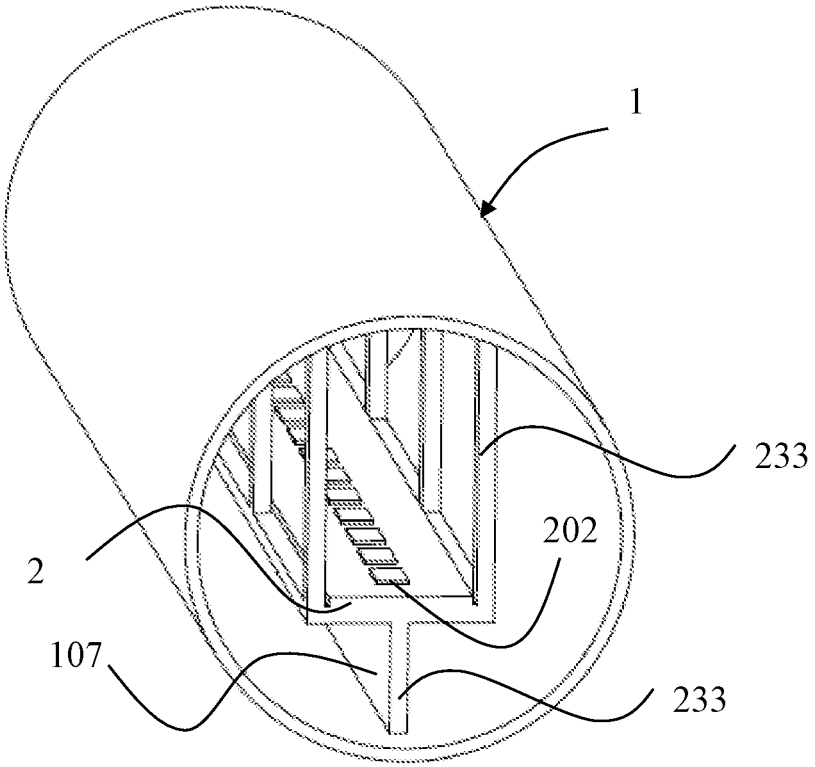
FIG. 10 is a perspective view of the lamp tube shown in FIG. 9.

Turning to FIGS. 9 and 10, in accordance with an exemplary embodiment of the claimed invention, the reinforcing portion 107 includes a plurality of vertical ribs 233. The vertical rib 233 is fixedly connected to the inner surface of the lamp tube 1 on one end and to the LED light strip 2 on the other end. The LED light assembly is thus spaced apart from inner surface of the plastic lamp tube 1. The plastic lamp tube 1 is protected from heat generated by the LED light assembly because the heat is taken away from the lamp tube 1 by the plurality of the vertical ribs 233. A cross section of the lamp tube 1 cuts through an LED light source 202, a first vertical rib 233 connected to an upper surface of the LED light assembly, a second vertical rib 233 connected to a lower surface of the LED light assembly or any combination of the above. In other words, the LED light assembly, the first vertical rib 233 and the second vertical rib 233 are aligned with one another, or alternatively, staggered. In an embodiment, the second vertical rib 233 connected to the lower surface of the LED light assembly is an unbroken structure extending along the longitudinal axis of the lamp tube 1 for better heat dissipation and more structural strength. In FIG. 10, the plurality of first vertical ribs 233 are spaced apart from one another like an array of pillars. However, the second vertical rib 233 extends uninterruptedly between the lower surface of the LED light assembly and the lamp tube 1 like a wall.

Figure 11:
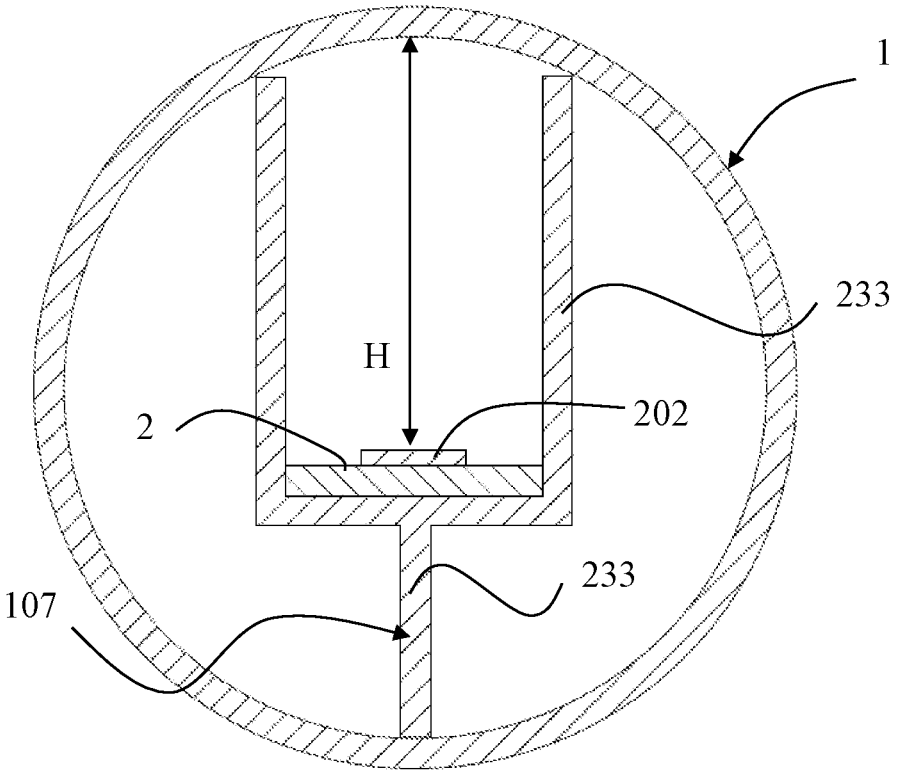
FIG. 11 is a cross-sectional view illustrating the bracing structure of the lamp tube in accordance with an exemplary embodiment of the claimed invention.

Turning to FIG. 11, in accordance with an exemplary embodiment of the claimed invention, the reinforcing portion 107 further includes a platform. The vertical rib 233 is fixedly connected to, instead of the LED light assembly, the platform on one end and to the inner surface on the other end. The vertical ribs 233 and the platform are thus one integral structure. The LED light assembly is thermally connected to an upper surface of the platform.

The position of the LED light strip 2 inside the lamp tube 1—i.e. the length of the first vertical rib 233 and the length of the second vertical rib 233—is chosen in light of a desired totality of factors such as field angle, heat-dissipating capability and structural strength. In FIGS. 9 and 11, the ratio of the distance (H) between the LED light strip 2 and the dome of the lamp tube 1 to the diameter of the lamp tube 1 is from 0.25 to 0.9, or most preferably, from 0.33 to 0.75.

Figure 12:
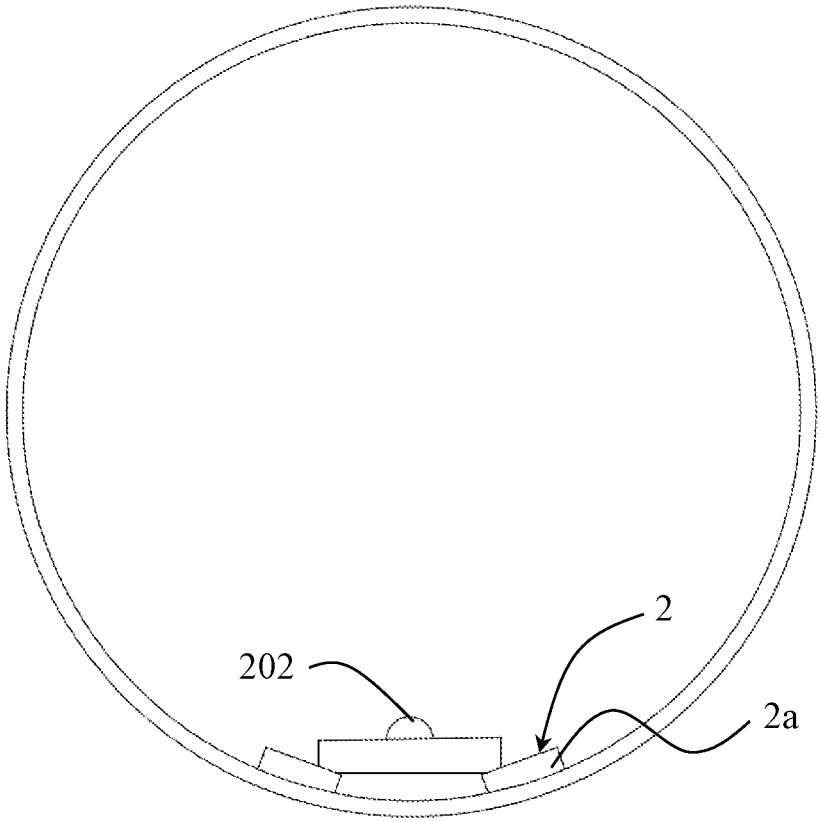
FIG. 12 is a cross-sectional view illustrating the LED light strip with a wiring layer in accordance with an exemplary embodiment of the claimed invention.
Figure 13:
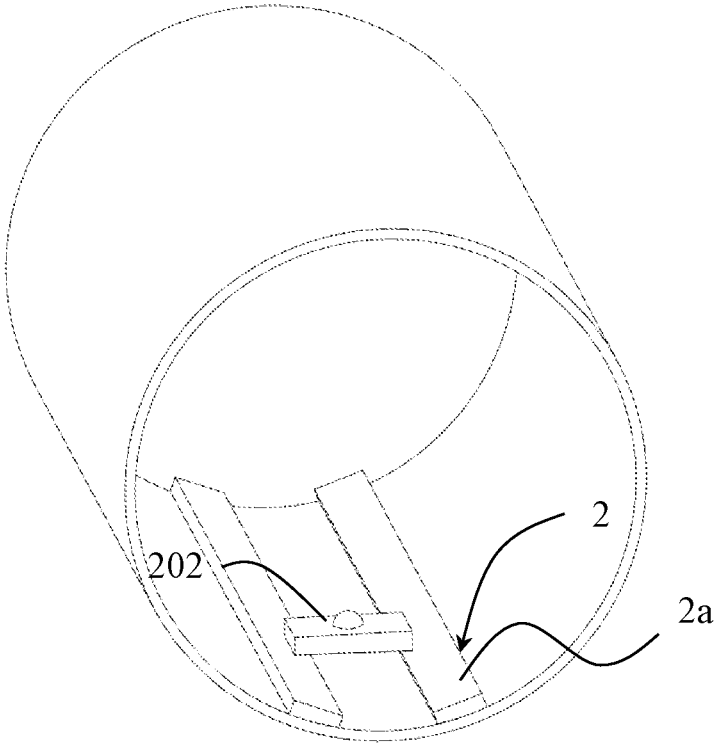
FIG. 13 is a perspective view of the lamp tube shown in FIG. 12.
Figure 16:
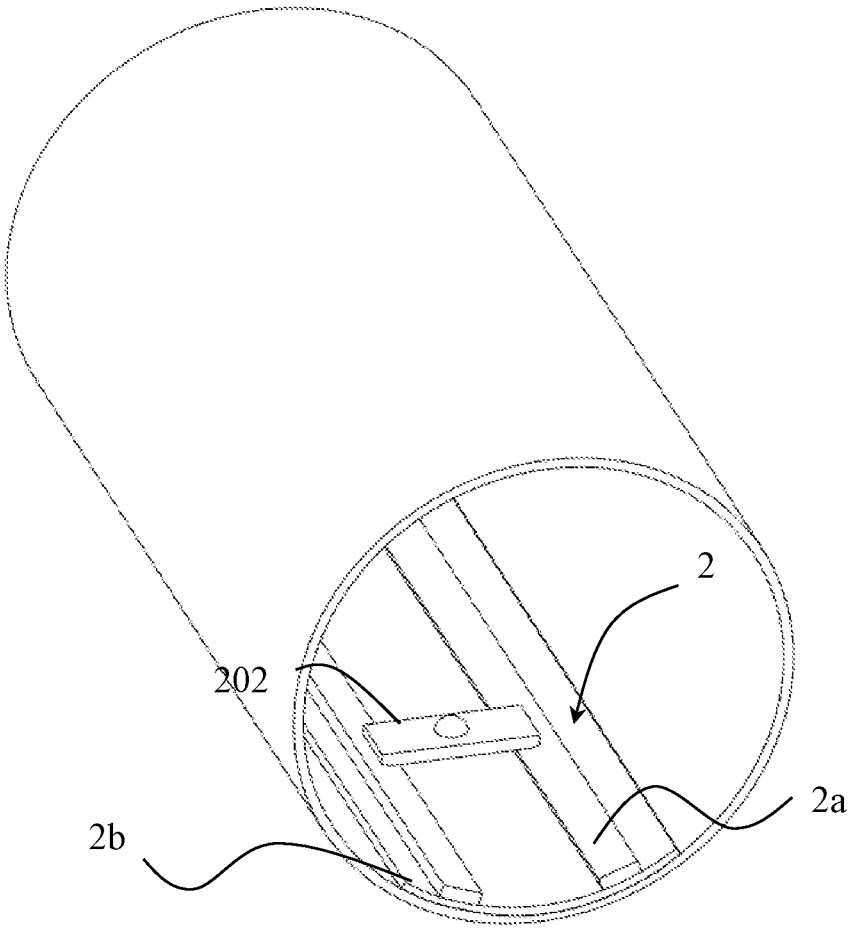
FIG. 16 is a perspective view illustrating a dielectric layer disposed on the wiring layer adjacent to the lamp tube in accordance with an exemplary embodiment of the claimed invention.
Figure 17:
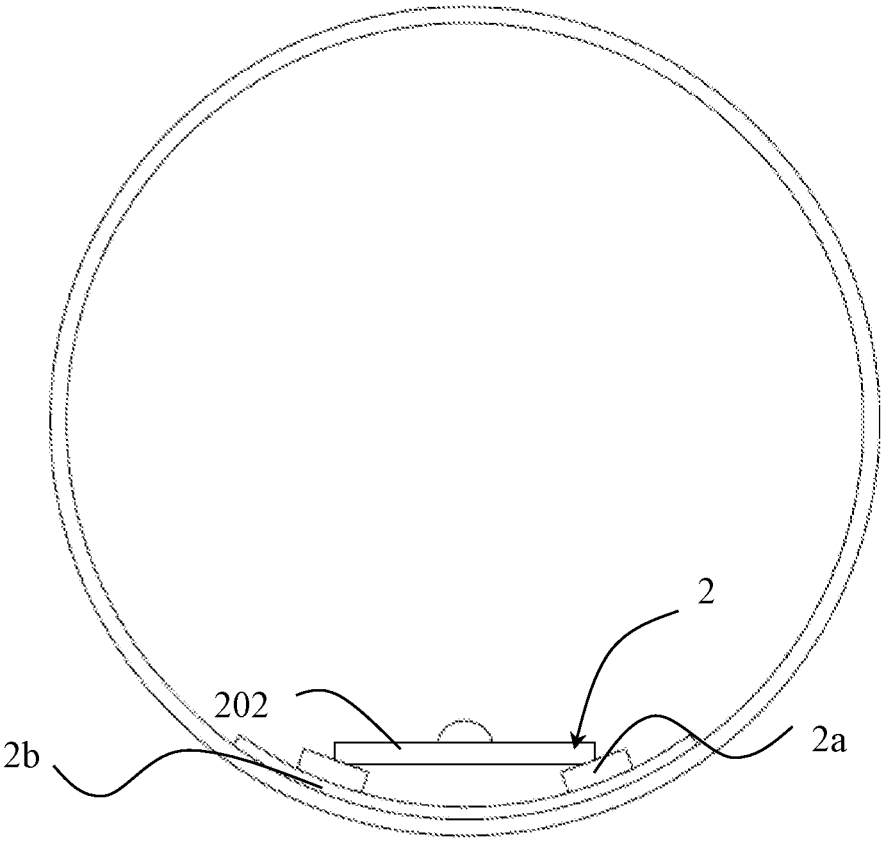
FIG. 17 is a perspective view of the lamp tube shown in FIG. 16.

In an embodiment, the LED light strip is made from flexible substrate material. Referring to FIGS. 12 and 13, in accordance with an exemplary embodiment of the claimed invention, the flexible LED light strip 2 includes a wiring layer 2*a*. The wiring layer 2*a* is an electrically conductive layer, e.g. a metallic layer or a layer of copper wire, and is electrically connected to the power supply. The LED light source 202 is disposed on and electrically connected to a first surface of the wiring layer 2*a*. Turning to FIGS. 16 and 17, the LED light strip 2 further includes a dielectric layer 2*b*.

The dielectric layer 2*b* is disposed on a second surface of the wiring layer 2*a*. The dielectric layer 2*b* has a different surface area than the wiring layer 2*a*. The LED light source 202 is disposed on a surface of the wiring layer 2*a* which is opposite to the other surface of the wiring layer 2*a* which is adjacent to the dielectric layer 2*b*. The wiring layer 2*a* can be a metal layer or a layer having wires such as copper wires.

In an embodiment, the LED light strip 2 further includes a protection layer over the wiring layer 2*a* and the dielectric layer 2*b*. The protection layer is made from one of solder resists such as liquid photoimageable.

Figure 14:
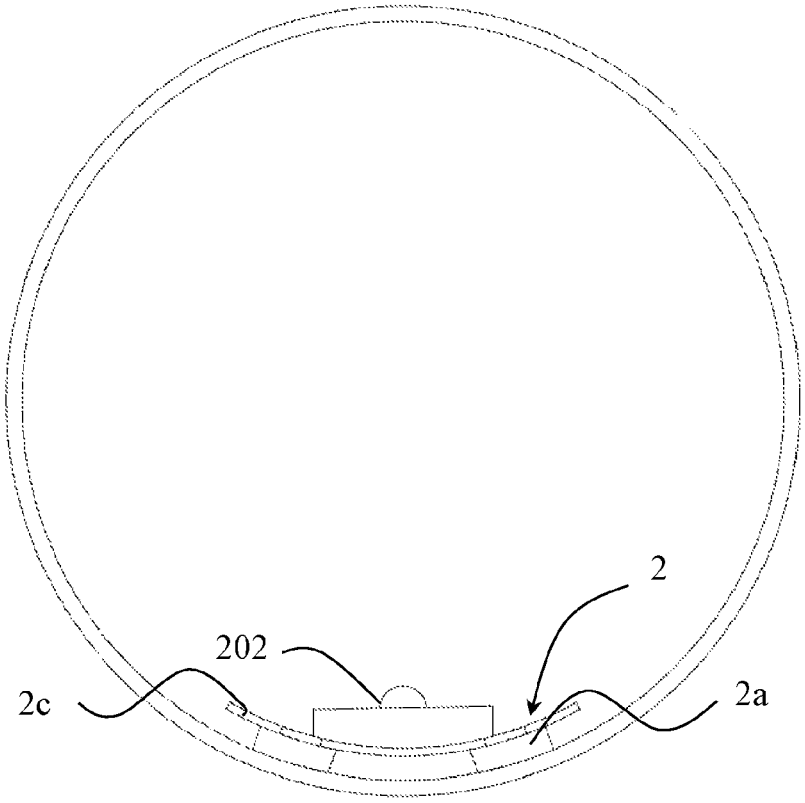
FIG. 14 is cross-sectional view illustrating a protection layer disposed on the wiring layer in accordance with an exemplary embodiment of the claimed invention.
Figure 15:
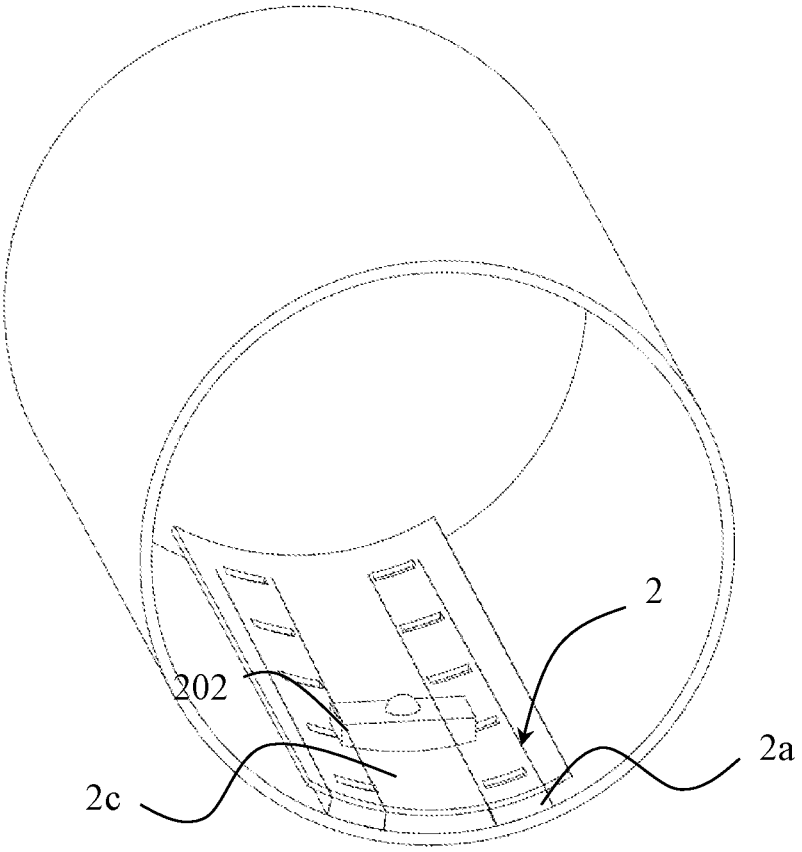
FIG. 15 is a perspective view of the lamp tube shown in FIG. 14.

In another embodiment, as shown in FIGS. 14 and 15, the outer surface of the wiring layer 2*a* or the dielectric layer 2*b* (i.e. the two layered structure) may be covered with a circuit protective layer 2*c* made of an ink with function of resisting soldering and increasing reflectivity. Alternatively, the dielectric layer 2*b* can be omitted and the wiring layer 2*a* can be directly bonded to the inner circumferential surface of the lamp tube (i.e. the one-layered structure), and the outer surface of the wiring layer 2*a* is coated with the circuit protective layer 2*c*. As shown in FIGS. 14 and 15, the circuit protective layer 2*c* is formed with openings such that the LED light sources 202 are electrically connected to the wiring layer 2*a*. Whether the one-layered or the two-layered structure is used, the circuit protective layer 2*c* can be adopted. The bendable circuit sheet is a one-layered structure made of just one wiring layer 2*a*, or a two-layered structure made of one wiring layer 2*a* and one dielectric layer 2*b*, and thus is more bendable or flexible to curl when compared with the conventional three-layered flexible substrate (one dielectric layer sandwiched with two wiring layers). As a result, the bendable circuit sheet of the LED light strip 2 can be installed in a lamp tube with a customized shape or non-tubular shape, and fitly mounted to the inner surface of the lamp tube. The bendable circuit sheet closely mounted to the inner surface of the lamp tube is preferable in some cases. In addition, using fewer layers of the bendable circuit sheet improves the heat dissipation and lowers the material cost.

In some embodiments, any type of power supply 5 can be electrically connected to the LED light strip 2 by means of a traditional wire bonding technique, in which a metal wire has an end connected to the power supply 5 while has the other end connected to the LED light strip 2. Furthermore, the metal wire may be wrapped with an electrically insulating tube to protect a user from being electrically shocked. However, the bonded wires tend to be easily broken during transportation and can therefore cause quality issues.

In still another embodiment, the connection between the power supply 5 and the LED light strip 2 may be accomplished via tin soldering, rivet bonding, or welding. One way to secure the LED light strip 2 is to provide the adhesive sheet at one side thereof and adhere the LED light strip 2 to the inner surface of the lamp tube 1 via the adhesive sheet. Two ends of the LED light strip 2 can be either fixed to or detached from the inner surface of the lamp tube 1.

In case that two ends of the LED light strip 2 are fixed to the inner surface of the lamp tube 1, it may be preferable that the bendable circuit sheet of the LED light strip 2 is provided with the female plug and the power supply is provided with the male plug to accomplish the connection between the LED light strip 2 and the power supply 5. In this case, the male plug of the power supply is inserted into the female plug to establish electrical connection.

In case that two ends of the LED light strip 2 are detached from the inner surface of the lamp tube and that the LED light strip 2 is connected to the power supply 5 via wire-bonding, any movement in subsequent transportation is likely to cause the bonded wires to break. Therefore, a preferable option for the connection between the light strip 2 and the power supply 5 could be soldering. Specifically, the ends of the LED light strip 2 including the bendable circuit sheet are arranged to pass over the strengthened transition region and directly soldering bonded to an output terminal of the power supply 5 such that the product quality is improved without using wires. In this way, the female plug and the male plug respectively provided for the LED light strip 2 and the power supply 5 are no longer needed.

Figure 18:
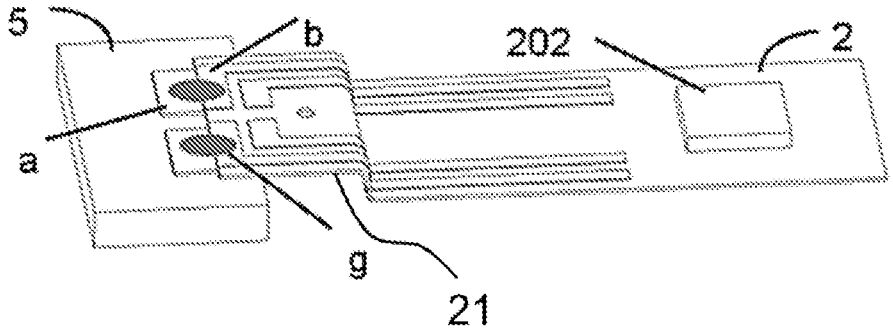
FIG. 18 is a perspective view illustrating a soldering pad on the bendable circuit sheet of the LED light strip to be joined together with the printed circuit board of the power supply in accordance with an exemplary embodiment of the claimed invention.
Figure 24:
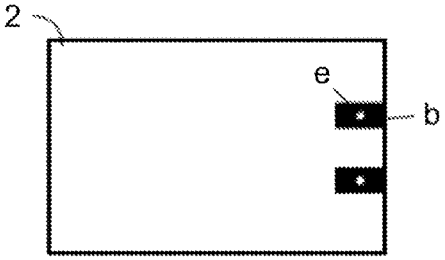
FIG. 24 is a planar view illustrating through holes formed on the soldering pads in accordance with an exemplary embodiment of the claimed invention.

Referring to FIG. 18, an output terminal of the printed circuit board of the power supply 5 may have soldering pads "a" provided with an amount of tin solder with a thickness sufficient to later form a solder joint. Correspondingly, the ends of the LED light strip 2 may have soldering pads "b". The soldering pads "a" on the output terminal of the printed circuit board of the power supply 5 are soldered to the soldering pads "b" on the LED light strip 2 via the tin solder on the soldering pads "a". The soldering pads "a" and the soldering pads "b" may be face to face during soldering such that the connection between the LED light strip 2 and the printed circuit board of the power supply 5 is the most firm. However, this kind of soldering requires that a thermo-compression head presses on the rear surface of the LED light strip 2 and heats the tine solder, i.e. the LED light strip 2 intervenes between the thermo-compression head and the tin solder, and therefor is easily to cause reliability problems. Referring to FIG. 24, a through hole may be formed in each of the soldering pads "b" on the LED light strip 2 to allow the soldering pads "b" overlay the soldering pads "b" without face-to-face and the thermo-compression head directly presses tin solders on the soldering pads "a" on surface of the printed circuit board of the power supply 5 when the soldering pads "a" and the soldering pads "b" are vertically aligned. This is an easy way to accomplish in practice.

Referring again to FIG. 18, two ends of the LED light strip 2 detached from the inner surface of the lamp tube 1 are formed as freely extending portions 21, while most of the LED light strip 2 is attached and secured to the inner surface of the lamp tube 1. One of the freely extending portions 21 has the soldering pads "b" as mentioned above. Upon assembling of the LED tube lamp, the freely extending end portions 21 along with the soldered connection of the printed circuit board of the power supply 5 and the LED light strip 2 would be coiled, curled up or deformed to be fittingly accommodated inside the lamp tube 1.

In this embodiment, during the connection of the LED light strip 2 and the power supply 5, the soldering pads "b" and the soldering pads "a" and the LED light sources 202 are on surfaces facing toward the same direction and the soldering pads "b" on the LED light strip 2 are each formed with a through hole "e" as shown in FIG. 24 such that the soldering pads "b" and the soldering pads "a" communicate with each other via the through holes "e". When the freely extending end portions 21 are deformed due to contraction or curling up, the soldered connection of the printed circuit board of the power supply 5 and the LED light strip 2 exerts a lateral tension on the power supply 5. Furthermore, the soldered connection of the printed circuit board of the power supply 5 and the LED light strip 2 also exerts a downward tension on the power supply 5 when compared with the situation where the soldering pads "a" of the power supply 5 and the soldering pads "b" of the LED light strip 2 are face to face. This downward tension on the power supply 5 comes from the tin solders inside the through holes "e" and forms a stronger and more secure electrical connection between the LED light strip 2 and the power supply 5.

Figure 19:
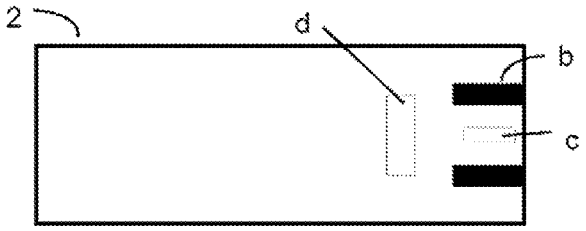
FIG. 19 is a planar view illustrating an arrangement of the soldering pads on the bendable circuit sheet of the LED light strip in accordance with an exemplary embodiment of the claimed invention.
Figure 20:
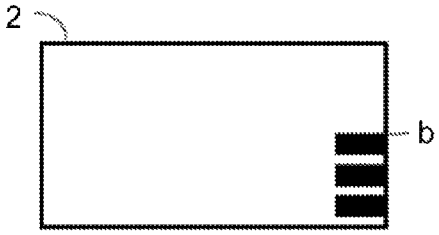
FIG. 20 is a planar view illustrating three soldering pads in a row on the bendable circuit sheet of the LED light strip in accordance with an exemplary embodiment of the claimed invention.
Figure 21:
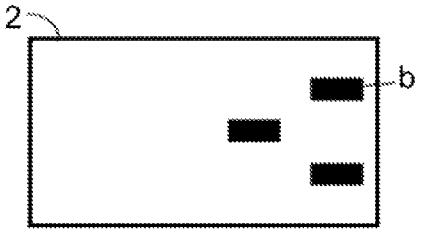
FIG. 21 is a planar view illustrating soldering pads sitting in two rows on the bendable circuit sheet of the LED light strip in accordance with an exemplary embodiment of the claimed invention.
Figure 22:
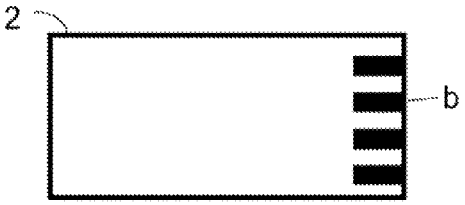
FIG. 22 is a planar view illustrating four soldering pads sitting in a row on the bendable circuit sheet of the LED light strip in accordance with an exemplary embodiment of the claimed invention.

Referring to FIG. 19, in one embodiment, the soldering pads "b" of the LED light strip 2 are two separate pads to electrically connect the positive and negative electrodes of the bendable circuit sheet of the LED light strip 2, respectively. The size of the soldering pads "b" may be, for example, about 3.5×2 mm2. The printed circuit board of the power supply 5 is corresponding provided with soldering pads "a" having reserved tin solders and the height of the tin solders suitable for subsequent automatic soldering bonding process is generally, for example, about 0.1 to 0.7 mm, in some embodiments 0.3 to 0.5 mm, and in some even more preferable embodiments about 0.4 mm. An electrically insulating through hole "c" may be formed between the two soldering pads "b" to isolate and prevent the two soldering pads from electrically short during soldering. Furthermore, an extra positioning opening "d" may also be provided behind the electrically insulating through hole "c" to allow an automatic soldering machine to quickly recognize the position of the soldering pads "b".

There are at least one soldering pads "b" for separately connected to the positive and negative electrodes of the LED light sources 202. For the sake of achieving scalability and compatibility, the amount of the soldering pads "b" on each end of the LED light strip 2 may be more than one such as two, three, four, or more than four. When there is only one soldering pad "b" provided at each end of the LED light strip 2, the two ends of the LED light strip 2 are electrically connected to the power supply 5 to form a loop, and various electrical components can be used. For example, a capacitance may be replaced by an inductance to perform current regulation. Referring to FIGS. 20 to 23, when each end of the LED light strip 2 has three soldering pads, the third soldering pad can be grounded; when each end of the LED light strip 2 has four soldering pads, the fourth soldering pad can be used as a signal input terminal. Correspondingly, the power supply 5 should has same amount of soldering pads "a" as that of the soldering pads "b" on the LED light strip 2. As long as electrical short between the soldering pads "b" can be prevented, the soldering pads "b" should be arranged according to the dimension of the actual area for disposition, for example, three soldering pads can be arranged in a row or two rows. In other embodiments, the amount of the soldering pads "b" on the bendable circuit sheet of the LED light strip 2 may be reduced by rearranging the circuits on the bendable circuit sheet of the LED light strip 2. The lesser the amount of the soldering pads, the easier the fabrication process becomes. On the other hand, a greater number of soldering pads may improve and secure the electrical connection between the LED light strip 2 and the output terminal of the power supply 5.

Referring to FIG. 24, in another embodiment, the soldering pads "b" each is formed with a through hole "e" having a diameter generally of about 1 to 2 mm, in some embodiments of about 1.2 to 1.8 mm, and in yet some embodiments of about 1.5 mm. The through hole "e" communicates the soldering pad "a" with the soldering pad "b" so that the tin solder on the soldering pads "a" passes through the through holes "e" and finally reach the soldering pads "b". A smaller through holes "e" would make it difficult for the tin solder to pass. The tin solder accumulates around the through holes "e" upon exiting the through holes "e" and condense to form a solder ball "g" with a larger diameter than that of the through holes "e" upon condensing. Such a solder ball "g" functions as a rivet to further increase the stability of the electrical connection between the soldering pads "a" on the power supply 5 and the soldering pads "b" on the LED light strip 2.

Figure 25:
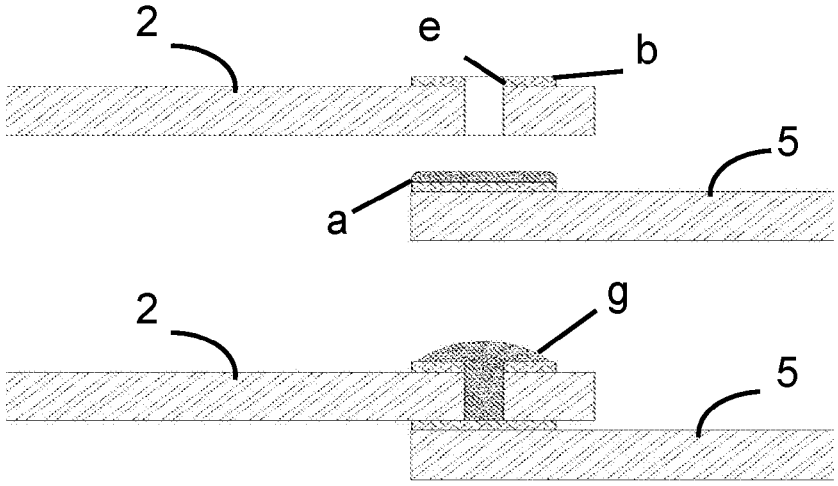
FIG. 25 is a cross-sectional view illustrating the soldering bonding process, which utilizes the soldering pads of the bendable circuit sheet of the LED light strip shown in FIG. 30 taken from side view and the printed circuit board of the power supply, in accordance with an exemplary embodiment of the claimed invention.
Figure 26:
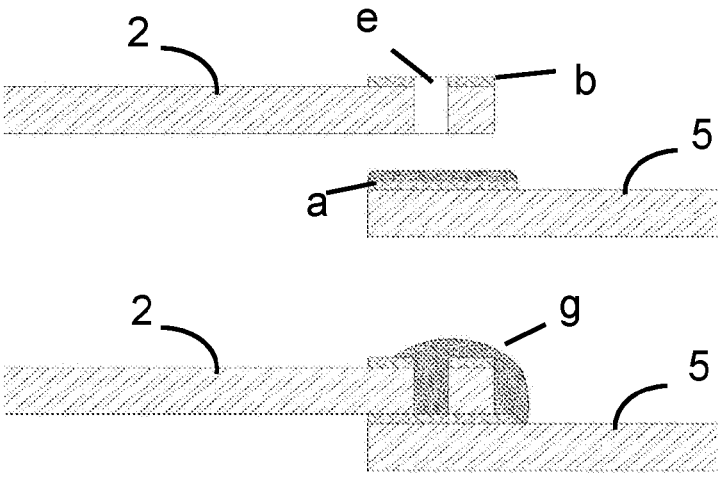
FIG. 26 is a cross-sectional view illustrating the soldering bonding process, which utilizes the soldering pads of the bendable circuit sheet of the LED light strip shown in FIG. 24, wherein the through hole of the soldering pads is near the edge of the bendable circuit sheet, in accordance with an exemplary embodiment of the claimed invention.
Figure 27:
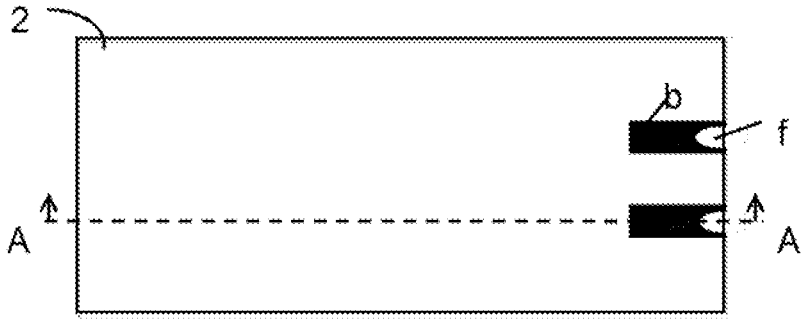
FIG. 27 is a planar view illustrating notches formed on the soldering pads in accordance with an exemplary embodiment of the claimed invention.
Figure 28:
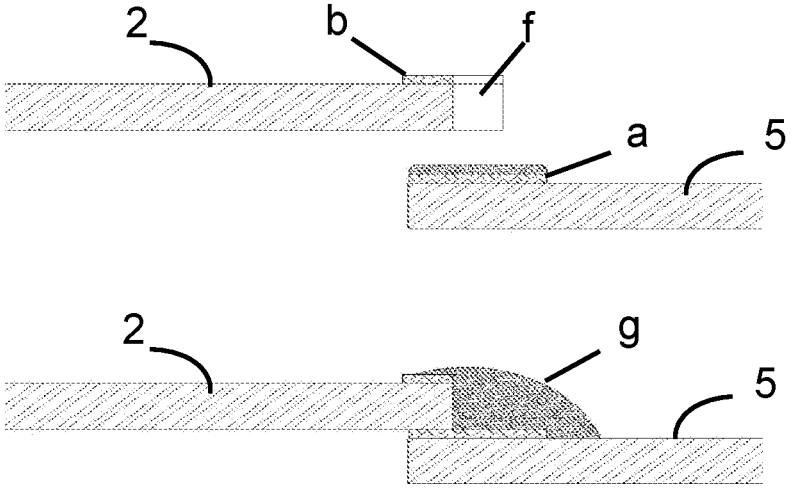
FIG. 28 is a cross-sectional view of the LED light strip shown in FIG. 27 along the line A-A.

Referring to FIGS. 25 to 26, in other embodiments, when a distance from the through hole "e" to the side edge of the LED light strip 2 is less than 1 mm, the tin solder may pass through the through hole "e" to accumulate on the periphery of the through hole "e", and extra tin solder may spill over the soldering pads "b" to reflow along the side edge of the LED light strip 2 and join the tin solder on the soldering pads "a" of the power supply 5. The tin solder then condenses to form a structure like a rivet to firmly secure the LED light strip 2 onto the printed circuit board of the power supply 5 such that reliable electric connection is achieved. Referring to FIGS. 27 and 28, in another embodiment, the through hole "e" can be replaced by a notch "f" formed at the side edge of the soldering pads "b" for the tin solder to easily pass through the notch "f" and accumulate on the periphery of the notch "f" and to form a solder ball with a larger diameter than that of the notch "e" upon condensing. Such a solder ball may be formed like a C-shape rivet to enhance the secure capability of the electrically connecting structure.

The abovementioned through hole "e" or notch "f" might be formed in advance of soldering or formed by direct punching with a thermo-compression head during soldering. The portion of the thermo-compression head for touching the tin solder may be flat, concave, or convex, or any combination thereof. The portion of the thermo-compression head for restraining the object to be soldered such as the LED light strip 2 may be strip-like or grid-like. The portion of the thermo-compression head for touching the tin solder does not completely cover the through hole "e" or the notch "f" to make sure that the tin solder is able to pass through the through hole "e" or the notch "f". The portion of the thermo-compression head being concave may function as a room to receive the solder ball.

Figure 31:
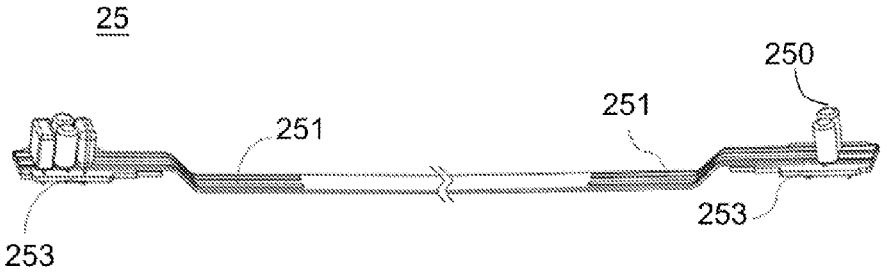
FIG. 31 is a perspective view of the circuit board assembly, which comprises the bendable circuit sheet of the LED light strip and the printed circuit board of the power supply, in accordance with an exemplary embodiment of the claimed invention.
Figure 32:
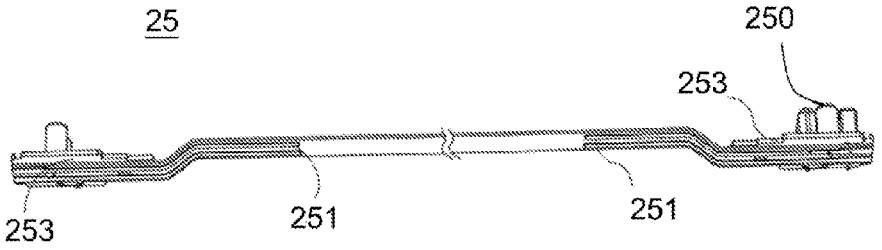
FIG. 32 is a perspective view of an alternative arrangement of the circuit board assembly shown in FIG. 31.

Referring to FIGS. 31 and 32, in another embodiment, the LED light strip 2 and the power supply 5 may be connected by utilizing a circuit board assembly 25 instead of soldering bonding. The circuit board assembly 25 has a long circuit sheet 251 and a short circuit board 253 that are adhered to each other with the short circuit board 253 being adjacent to the side edge of the long circuit sheet 251. The short circuit board 253 may be provided with power supply module 250 to form the power supply 5. The short circuit board 253 is stiffer or more rigid than the long circuit sheet 251 to be able to support the power supply module 250.

Figure 23:
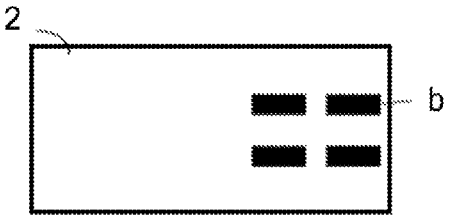
FIG. 23 is a planar view illustrating soldering pads sitting in a two by two matrix on the bendable circuit sheet of the LED light strip in accordance with an exemplary embodiment of the claimed invention.

The long circuit sheet 251 may be the bendable circuit sheet of the LED light strip including a wiring layer **2*a* as shown in FIG. 23. The wiring layer 2*a* of the long circuit sheet 251 and the power supply module 250 may be electrically connected in various manners depending on the demand in practice. As shown in FIG. 31, the power supply module 250 and the long circuit sheet 251 having the wiring layer 2*a* on surface are on the same side of the short circuit board 253 such that the power supply module 250 is directly connected to the long circuit sheet 251. As shown in FIG. 32, alternatively, the power supply module 250 and the long circuit sheet 251 including the wiring layer 2*a* on surface are on opposite sides of the short circuit board 253 such that the power supply module 250 is directly connected to the short circuit board 253 and indirectly connected to the wiring layer 2*a* of the LED light strip 2 by way of the short circuit board 253**.

As shown in FIG. 31, in one embodiment, the long circuit sheet 251 and the short circuit board 253 are adhered together in the first place, and the power supply module 250 is subsequently mounted on the wiring layer 2*a* of the long circuit sheet 251 serving as the LED light strip 2. The long circuit sheet 251 of the LED light strip 2 herein is not limited to include only one wiring layer 2*a* and may further include another wiring layer such as the wiring layer. The light sources 202 are disposed on the wiring layer 2*a* of the LED light strip 2 and electrically connected to the power supply 5 by way of the wiring layer 2*a*. As shown in FIG. 36, in another embodiment, the long circuit sheet 251 of the LED light strip 2 may include a wiring layer 2*a* and a dielectric layer 2*b*. The dielectric layer 2*b* may be adhered to the short circuit board 253 in a first place and the wiring layer 2*a* is subsequently adhered to the dielectric layer 2*b* and extends to the short circuit board 253. All these embodiments are within the scope of applying the circuit board assembly concept of the present invention.

In the above-mentioned embodiments, the short circuit board 253 may have a length generally of about 15 mm to about 40 mm and in some embodiments about 19 mm to about 36 mm, while the long circuit sheet 251 may have a length generally of about 800 mm to about 2800 mm and in some embodiments of about 1200 mm to about 2400 mm. A ratio of the length of the short circuit board 253 to the length of the long circuit sheet 251 ranges from, for example, about 1:20 to about 1:200.

Figure 33:
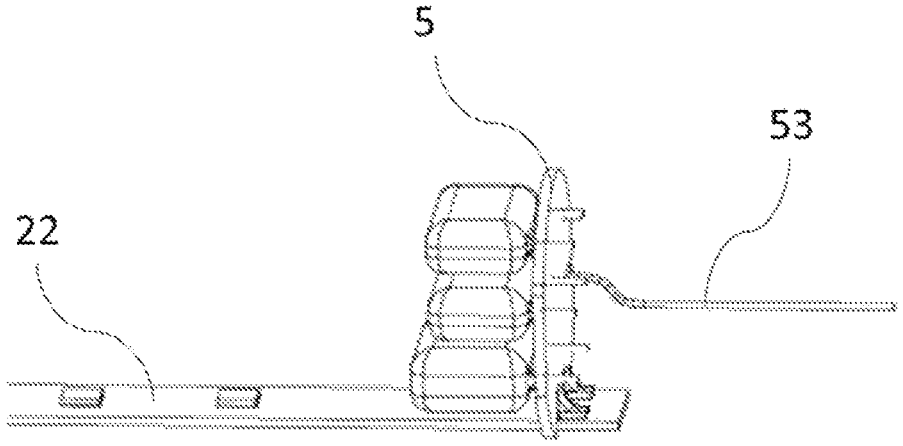
FIG. 33 is a perspective view of the printed circuit board of the power supply, which is perpendicularly adhered to a hard circuit board made of aluminum via soldering, in accordance with an exemplary embodiment of the claimed invention.
Figure 34:
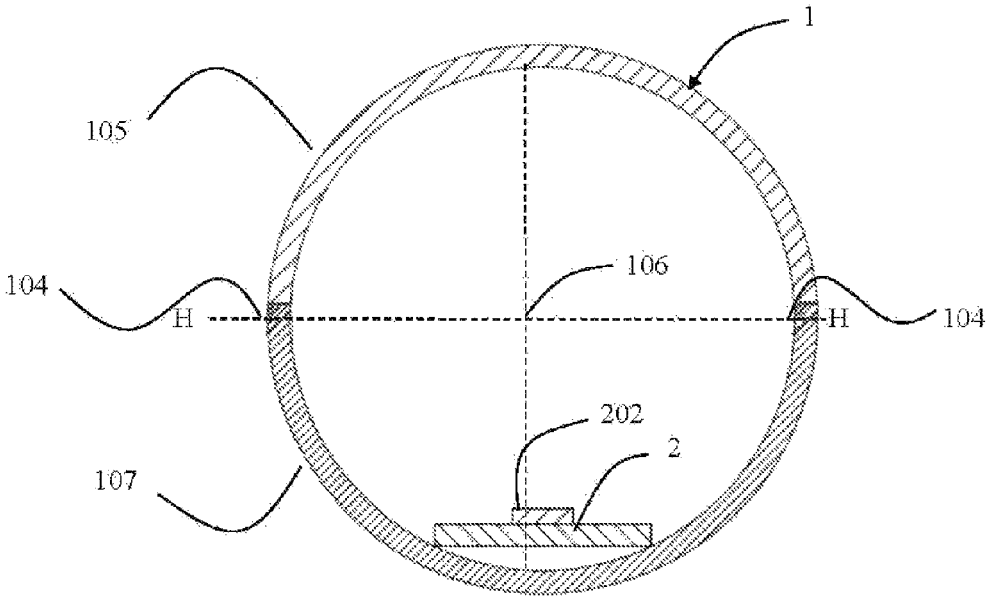
FIG. 34 is a cross-sectional view of the LED tube lamp with a light transmissive portion and a reinforcing portion in accordance with an exemplary embodiment of the claimed invention.

Referring to FIG. 33, in one embodiment, a hard circuit board 22 made of aluminum is used instead of the bendable circuit sheet, such that the ends or terminals of the hard circuit board 22 can be mounted at ends of the lamp tube 1, and the power supply 5 is soldering bonded to one of the ends or terminals of the hard circuit board 22 in a manner that the printed circuit board of the power supply 5 is not parallel but may be perpendicular to the hard circuit board 22 to save space in the longitudinal direction needed for the end cap. This soldering bonding technique is more convenient to accomplish and the effective illuminating areas of the LED tube lamp could also be remained. Moreover, a conductive lead 53 for electrical connection with the end cap 3 could be formed directly on the power supply 5 without soldering other metal wires between the power supply 5 and the hollow conductive pin 301, and which facilitates the manufacturing of the LED tube lamp.

Figure 30:
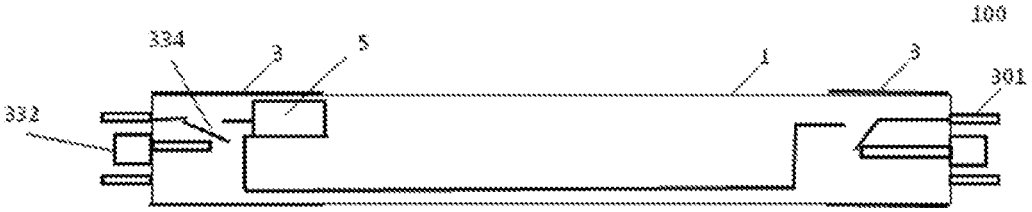
FIG. 30 is a schematic view of the end cap in accordance with an exemplary embodiment of the claimed invention.

Turing to FIG. 30, in accordance with an exemplary embodiment of the claimed invention, the end cap 3 includes a housing 300, an electrically conductive pin 301, a power supply 5 and a safety switch. The end cap 3 is configured to turn on the safety switch and make a circuit connecting, sequentially, mains electricity coming from a socket, the electrically conductive pin 301, the power supply 5 and the LED light assembly—when the electrically conductive pin 301 is plugged into the socket. The end cap 3 is configured to turn off the safety switch and open the circuit when the electrically conductive pin 301 is unplugged from the socket. The lamp tube 1 is thus configured to minimize risk of electric shocks during installation and to comply with safety regulations.

In some embodiments, the safety switch directly—and mechanically—makes and breaks the circuit of the LED tube lamp. In other embodiments, the safe switch 334 controls another electrical circuit, i.e. a relay, which in turn makes and breaks the circuit of the LED tube lamp. Some relays use an electromagnet to operate a switching mechanism mechanically, but other operating principles are also used. For example, solid-state relays control power circuits with no moving parts, instead using a semiconductor device to perform switching.

The proportion of the end cap 3 in relation to the lamp tube 1 schematized in FIG. 30 is exaggerated in order to highlight the structure of the end cap 3. In an embodiment, the depth of the end cap 3 is from 9 to 70 mm. The axial length of the lamp tube 1 is from 254 to 2000 mm.

In an embodiment, a first end cap of the lamp tube includes a safety switch but a second end cap does not. A warning is attached to the first end cap to alert an operator to plug in the second end cap before moving on to the first end cap.

In an embodiment, the safety switch includes a level switch. The level switch is turned on when the liquid inside is made to flow to a designated place. The end cap 3 is configured to turn on the level switch and, directly or through a relay, make the circuit only when the electrically conductive pin 301 is plugged into the socket. Alternatively, the safety switch includes a micro switch. The end cap 3 is configured to, likewise, turn on the micro switch and, directly or through a relay, make the circuit only when the electrically conductive pin 301 is plugged into the socket.

Figure 29A:
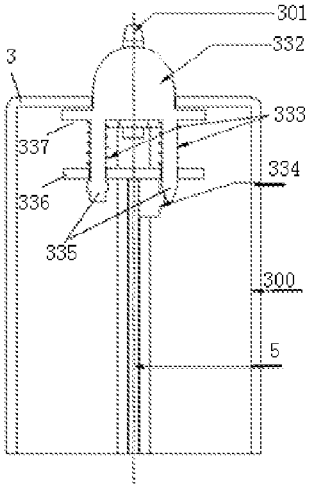
FIGS. 29A-F are schematic views of an end cap including a safety switch in accordance with an exemplary embodiment of the claimed invention.

Turning to FIG. 29A, in accordance with an exemplary embodiment of the claimed invention, the end cap 3 includes a housing 300; an electrically conductive pin 301 extending outwardly from a top wall of the housing 300; an actuator 332 movably connected to the housing; and a micro switch 334. The upper portion of the actuator 332 projects out of an opening formed in the top wall of the housing 300. The actuator 332 includes, inside the housing 300, a stopping flange 337 extending radially from its intermediary portion and a shaft 335 extending axially in its lower portion. The shaft 335 is movably connected to a base 336 rigidly mounted inside the housing 300. A preloaded coil 333 spring is retained, around the shaft 335, between the stopping flange 337 and the base 336. An aperture is provided in the upper portion of the actuator 332 through which the electrically conductive pin 301 is arranged. The micro switch 334 is positioned inside the housing 300 to be actuated by the shaft 335 at a predetermined actuation point. The micro switch 334, when actuated, makes the circuit, directly or through a relay, between the electrically connective pin 301 and the power supply 5. The actuator 332 is aligned with the electrically conductive pin 301, the opening in the top wall of the housing 300 and the coil spring 333 along the longitudinal axis of the lamp tube 1 to be reciprocally movable between the top wall of the housing 300 and the base 336. When the electrically conductive pin 301 is unplugged from the socket, the coil spring 333 biases the actuator 332 to its rest position until the stopping flange 337 is urged against the top wall of the housing 300. The micro switch 334 stays off and the circuit of the LED tube lamp stays open. When the electrically conductive pin 301 is duly plugged into the socket on a lamp holder, the actuator 332 is depressed and brings the shaft 335 to the actuation point. The micro switch 334 is turned on to, directly or through a relay, complete the circuit of the LED tube lamp.

Figure 29B:
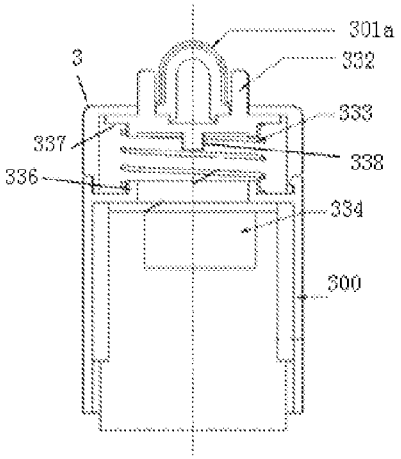

Turning to FIG. 29B, in accordance with an exemplary embodiment of the claimed invention, the end cap 3 includes a housing 300; an electrically conductive pin 301 extending outwardly from a top wall of the housing 300; an actuator 332 movably connected to the housing; and a micro switch 334. In an embodiment, the electrically conductive pin 301 is an enlarged hollow structure. The upper portion of the actuator 332 is bowl-shaped to receive the electrically conductive pin 301 and projects out of an opening formed in the top wall of the housing 300. The actuator 332 includes, inside the housing 300, a stopping flange 337 extending radially from its intermediary portion and, in its lower portion, a spring retainer and a bulging part 338. A preloaded coil spring 333 is retained between the string retainer and a base 336 rigidly mounted inside the housing 300. The micro switch 334 is positioned inside the housing 300 to be actuated by the bulging part 338 at a predetermined actuation point. The micro switch 334, when actuated, makes the circuit, directly or through a relay, between the electrically conductive pin 301 and the power supply. The actuator 332 is aligned with the electrically conductive pin 301, the opening in the top wall of the housing 300 and the coil spring 333 along the longitudinal axis of the lamp tube 1 to be reciprocally movable between the top wall of the housing 300 and the base 336. When the electrically conductive pin is unplugged from the socket of a lamp holder, the coil spring 333 biases the actuator 332 to its rest position until the stopping flange 337 is urged against the top wall of the housing 300. The micro switch 334 stays off and the circuit of the LED tube lamp 1 stays open. When the electrically conductive pin 301 is duly plugged into the socket on the lamp holder, the actuator 332 is depressed and brings the bulging part 338 to the actuation point. The micro switch 334 is turned on to, directly or through a relay, complete the circuit.

Figure 29C:
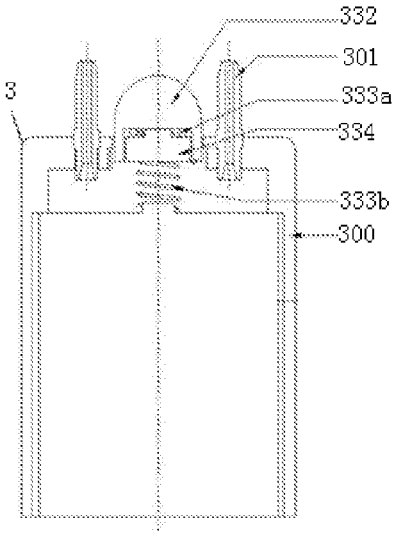

Turning to FIG. 29C, in accordance with an exemplary embodiment of the claimed invention, the end cap 3 includes a housing 300; a power supply (not shown); an electrically conductive pin 301 extending outwardly from a top wall of the housing 300; an actuator 332 movably connected to the housing; and a micro switch 334. In an embodiment, the end cap includes a pair of electrically conductive pins 301. The upper portion of the actuator 332 projects out of an opening formed in the top wall of the housing 300. The actuator 332 includes, inside the housing 300, a stopping flange 337 extending radially from its intermediary portion and a spring retainer in its lower portion. A first coil spring 333*a*, preloaded, is retained between the string retainer and a first end of the micro switch 334. A second coil spring 333*b*, also preloaded, is retained between a second end of the micro switch 334 and a base rigidly mounted inside the housing. Both of the springs 333*a*, 333*b* are chosen to respond to a gentle depression; however, the first coil spring 333*a* is chosen to have a different stiffness than the second coil spring 333*b*. Preferably, the first coil spring 333*a* reacts to a depression of from 0.5 to 1 N but the second coil spring 333*b* reacts to a depression of from 3 to 4 N. The actuator 332 is aligned with the opening in the top wall of the housing 300, the micro switch 334 and the set of coil springs 333*a*, 333*b* along the longitudinal axis of the lamp tube to be reciprocally movable between the top wall of the housing 300 and the base. The micro switch 334, sandwiched between the first coil spring 333*a* and the second coil spring 333*b*, is actuated when the first coil spring 333*a* is compressed to a predetermined actuation point. The micro switch 334, when actuated, makes the circuit, directly or through a relay, between the pair of electrically conductive pins 301 and the power supply. When the pair of electrically conductive pins 301 are unplugged from the socket on a lamp holder, the pair of coil springs 333*a*, 333*b* bias the actuator 332 to its rest position until the stopping flange 337 is urged against the top wall of the housing 300. The micro switch 334 stays off and the circuit of the LED tube lamp stays open. When the pair of electrically conductive pins 301 are duly plugged into the socket on a lamp holder, the actuator 332 is depressed and compresses the first coil spring 333*a* to the actuation point. The micro switch 334 is turned on to, directly or through a relay, complete the circuit.

Figure 29D:
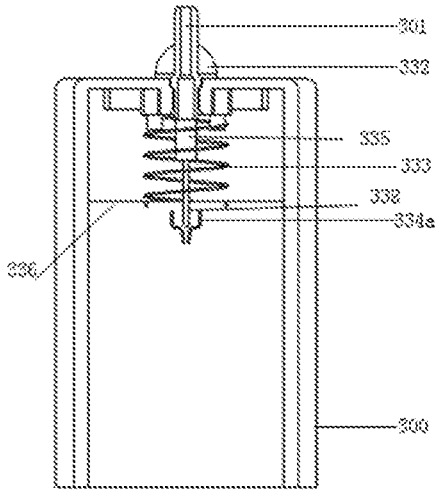

Turning to FIG. 29D, in accordance with an exemplary embodiment of the claimed invention, the end cap 3 includes a housing 300; a power supply (not shown); an electrically conductive pin 301 extending outwardly from a top wall of the housing 300; an actuator 332 movably connected to the housing; a first contact element 334*a*; and a second contact element 338. The upper portion of the actuator 332 projects out of an opening formed in the top wall of the housing 300. The actuator 332 includes, inside the housing 300, a stopping flange extending radially from its intermediary portion and a shaft 335 extending axially in its lower portion. The shaft 335 is movably connected to a base 336 rigidly mounted inside the housing 300. A preloaded coil spring 333 is retained, around the shaft 335, between the stopping flange and the base 336. An aperture is provided in the upper portion of the actuator 332 through which the electrically conductive pin 301 is arranged. The actuator 332 is aligned with the electrically conductive pin 301, the opening in the top wall of the housing 300, the coil spring 333 and the first and second contact elements 334*a*, 338 along the longitudinal axis of the lamp tube to be reciprocally movable between the top wall of the housing 300 and the base 336. The first contact element 334*a* includes a plurality of metallic pieces, which are spaced apart from one another, and is configured to form a flexible female-type receptacle, e.g. V-shaped or bell-shaped. The first contact element 334*a* is made from copper or copper alloy. The second contact element 338 is positioned on the shaft 335 to, when the shaft 335 moves downwards, come into the first contact element 334*a* and electrically connect the plurality of metallic pieces at a predetermined actuation point. The first contact element 334*a* is configured to impart a spring-like bias on the second contact element 338 when the second contact element 338 goes into the first contact element 334*a* to ensure faithful electrical connection with one another. The first and second contact elements 334*a*, 338 are made from, preferably, copper alloy. When the electrically conductive pin 301 is unplugged from the socket, the coil spring 333 biases the actuator 332 to its rest position until the stopping flange is urged against the top wall of the housing 300. The first and second contact elements 334*a*, 338 stay unconnected and the circuit of the LED tube lamp stays open. When the electrically conductive pin 301 is duly plugged into the socket on a lamp holder, the actuator 332 is depressed and brings the second contact element 338 to the actuation point. The first and second contact elements 334*a*, 338 are connected to, directly or through a relay, complete the circuit of the LED tube lamp.

Figure 29E:
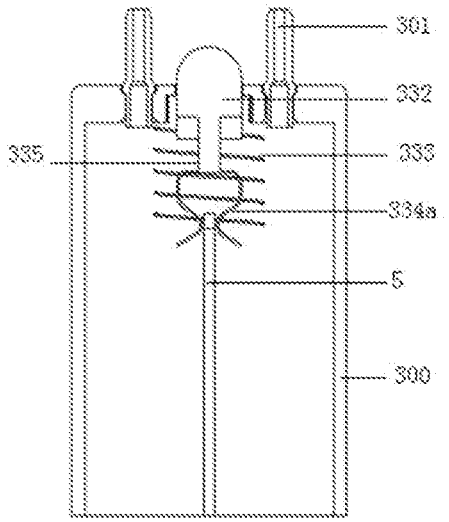

Turning to FIG. 29E, in accordance with an exemplary embodiment of the claimed invention, the end cap 3 includes a housing 300; a power supply 5; an electrically conductive pin 301 extending outwardly from a top wall of the housing 300; an actuator 332 movably connected to the housing; a first contact element 334*a*; and a second contact element. The upper portion of the actuator 332 projects out of an opening formed in the top wall of the housing 300. The actuator 332 includes, inside the housing 300, a stopping flange extending radially from its intermediary portion and a shaft 335 extending axially in its lower portion. The shaft 335 is movably connected to a base rigidly mounted inside the housing 300. A preloaded coil spring 333 is retained, around the shaft 335, between the stopping flange and the base. The actuator 332 is aligned with the electrically conductive pin 301, the opening in the top wall of the housing 300, the coil spring 333, the first contact element 334*a* and the second contact element along the longitudinal axis of the lamp tube to be reciprocally movable between the top wall of the housing 300 and the base. The first contact element 334*a* forms an integral and flexible female-type receptacle and is made from, preferably, copper, copper alloy or both. The second contact element, made from, preferably, copper, copper alloy or both, is fixedly disposed inside the housing 300. In an embodiment, the second contact element is fixedly disposed on the power supply 5. The first contact element 334*a* is attached to the lower end of the shaft 335 to, when the shaft 335 moves downwards, receive and electrically connect the second contact element at a predetermined actuation point. The first contact element 334*a* is configured to impart a spring-like bias on the second contact element when the former receives the latter to ensure faithful electrical connection with each other. When the electrically conductive pin 301 is unplugged from the socket on a lamp holder, the coil spring 333 biases the actuator 332 to its rest position until the stopping flange is urged against the top wall of the housing 300. The first contact element 334*a* and the second contact element stay unconnected and the circuit of the LED tube lamp stays open. When the electrically conductive pin 301 is duly plugged into the socket, the actuator 332 is depressed and brings the first contact element 334*a* to the actuation point. The first contact element 334*a* and the second contact element are connected to, directly or through a relay, complete the circuit of the LED tube lamp.

Figure 29F:
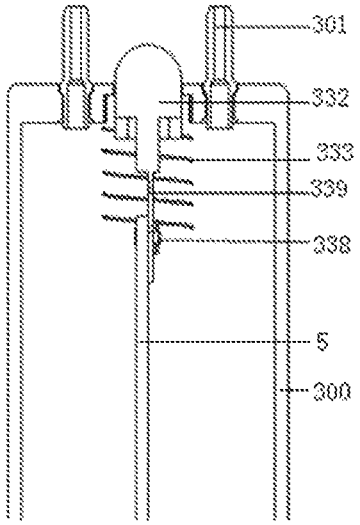

Turning to FIG. 29F, in accordance with an exemplary embodiment of the claimed invention, the end cap 3 includes a housing 300; a power supply 5; an electrically conductive pin 301 extending outwardly from a top wall of the housing 300; an actuator 332 movably connected to the housing; a first contact element 334*b*; and a second contact element. The upper portion of the actuator 332 projects out of an opening formed in the top wall of the housing 300. The actuator 332 includes, inside the housing 300, a stopping flange extending radially from its intermediary portion and a shaft 335 extending axially in its lower portion. The shaft 335 is movably connected to a base rigidly mounted inside the housing 300. A preloaded coil spring 333 is retained, around the shaft 335, between the stopping flange and the base. The actuator 332 is aligned with the electrically conductive pin 301, the opening in the top wall of the housing 300, the coil spring 333, the first contact element 334*b* and the second contact element along the longitudinal axis of the lamp tube to be reciprocally movable between the top wall of the housing 300 and the base. The shaft 335 includes a non-electrically conductive body in the shape of an elongated thin plank and a window 339 carved out from the body. The first contact element 334*b* and the second contact element are fixedly disposed inside the housing 300 and face each other through the shaft 335. The first contact element 334*b* is configured to impart a spring-like bias on the shaft 335 and to urge the shaft 335 against the second contact element. In an embodiment, the first contact element 334*b* is a bow-shaped laminate bending towards the shaft 335 and the second contact element, which is disposed on the power supply 5. The first contact element 334*b* and the second contact element are made from, preferably, copper, copper alloy or both. When the actuator 332 is in its rest position, the first contact element 334*b* and the second contact element are prevented by the body of the shaft 335 from engaging each other. However, the first contact element 334*b* is configured to, when the shaft brings its window 339 downwards to a predetermined actuation point, engage and electrically connect the second contact element through the window 339. When the electrically conductive pin 301 is unplugged from the socket, the coil spring 333 biases the actuator 332 to its rest position until the stopping flange is urged against the top wall of the housing 300. The first contact element 334*b* and the second contact element stay unconnected and the circuit of the LED tube lamp stays open. When the electrically conductive pin 301 is duly plugged into the socket on a lamp holder, the actuator 332 is depressed and brings the window 339 to the actuation point. The first contact element 334*b* engages the second contact element to, directly or through a relay, complete the circuit of the LED tube lamp.

In an embodiment, the upper portion of the actuator 332 that projects out of the housing 300 is shorter than the electrically conductive pin 301. Preferably, the ratio of the depth of the upper portion of the actuator 332 to that of the electrically conductive pin 301 is from 20% to 95%.

Having described at least one of the embodiments of the claimed invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents. Specifically, one or more limitations recited throughout the specification can be combined in any level of details to the extent they are described to improve the LED tube lamp. These limitations include, but are not limited to: light transmissive portion and reinforcing portion; platform and bracing structure; vertical rib, horizontal rib and curvilinear rib; thermally conductive plastic and light transmissive plastic; silicone-based matrix having good thermal conductivity; anti-reflection layer; roughened surface; electrically conductive wiring layer; wiring protection layer; ridge; maintaining stick; and shock-preventing safety switch.

What is claimed is:

1. An LED tube lamp, comprising:

a lamp tube, which includes a light transmissive portion, a reinforcing portion and an end cap; and an LED light assembly, which includes an LED light source and an LED light strip, wherein:

the light transmissive portion is fixedly connected to the reinforcing portion;

the reinforcing portion includes a platform and a bracing structure;

the bracing structure is fixedly connected to the platform and holds the platform in place;

the bracing structure is made from a material having a greater stiffness than a material from which the transmissive portion is made;

the LED light source is thermally and electrically connected to the LED light strip, which is in turn thermally connected to the reinforcing portion;

the end cap is attached to an end of the lamp tube;

the light transmissive portion and the reinforcing portion define a first line between them on a cross section of the lamp tube;

the lamp tube has a shape of a circular cylinder;

a cross section of an inner surface of the lamp tube defines a hypothetical circle;

a second line parallel to the first line on the cross section cuts the circle horizontally into two equal halves along a diameter of the circle;

a cross section of the light transmissive portion defines an upper segment on the circle;

a cross section of the reinforcing portion defines a lower segment on the circle;

the bracing structure is made from one of metal, metal alloy and plastic; and a ratio of a cross-sectional area of the bracing structure to a cross-sectional area of the lamp tube is from 1:3 to 1:30.

2. An LED tube lamp, comprising:

a lamp tube, which includes a light transmissive portion, a reinforcing portion, a ridge and an end cap; and an LED light assembly, which includes an LED light source and an LED light strip, wherein:

the light transmissive portion is fixedly connected to the reinforcing portion;

the reinforcing portion includes a platform and a bracing structure;

the LED light strip is disposed on the platform;

the bracing structure is fixedly connected to the platform and holds the platform in place;

the bracing structure is made from a material having a greater stiffness than a material from which the light transmissive portion is made;

the LED light source is thermally and electrically connected to the LED light strip, which is in turn thermally connected to the reinforcing portion;

the end cap is attached to an end of the lamp tube;

the light transmissive portion and the reinforcing portion define a first line between them on a cross section of the lamp tube;

the lamp tube has a shape of a circular cylinder;

a cross section of an inner surface of the lamp tube defines a hypothetical circle;

a second line parallel to the first line on the cross section cuts the circle horizontally into two equal halves along a diameter of the circle;

a cross section of the light transmissive portion defines an upper segment on the circle;

a cross section of the reinforcing portion defines a lower segment on the circle;

the bracing structure includes a curvilinear rib;

a cross section of the curvilinear rib defines a lower arc on the circle;

an outer surface of the reinforcing portion forms an outer surface of the lamp tube;

the ridge is an elongated structure extending in an axial direction along an inner surface of the lamp tube;

the bracing structure is made from one of metal, metal alloy and plastic; and a ratio of a cross-sectional area of the bracing structure to a cross-sectional area of the lamp tube is from 1:3 to 1:30.

3. An LED tube lamp, comprising:

a lamp tube, which includes a light transmissive portion, a reinforcing portion and an end cap; and an LED light assembly, which includes an LED light source and an LED light strip, wherein:

the light transmissive portion is fixedly connected to the reinforcing portion;

the reinforcing portion includes a platform and a bracing structure;

the bracing structure is fixedly connected to the platform;

the bracing structure is made from a material having a greater stiffness than a material from which the light transmissive portion is made;

the LED light source is thermally and electrically connected to the LED light strip, the LED light strip is thermally connected to the reinforcing portion;

the end cap is attached to an end of the lamp tube;

the lamp tube has a shape of a circular cylinder;

the bracing structure is made from one of metal, metal alloy and plastic; and a ratio of a cross-sectional area of the bracing structure to a cross-sectional area of the lamp tube is from 1:3 to 1:30.

4. The LED tube lamp in claim 3, wherein:

a cross section of the lamp tube defines a hypothetical circle;

the light transmissive portion and the reinforcing portion define a first line between them on a cross section of the lamp tube, the first line cuts the circle horizontally into an upper segment and a lower segment;

a second line parallel to the first line on the cross section cuts the circle horizontally into two equal halves along a diameter of the circle;

the first line sits below the second line; and the upper segment, which comprises the light transmissive portion, has a greater area than the lower segment, which comprises the reinforcing portion.

5. The LED tube lamp in claim 4, wherein:

the bracing structure further includes a vertical rib; and an end of the vertical rib connects the curvilinear rib.

6. The LED tube lamp in claim 3, wherein:

a cross section of the lamp tube defines a hypothetical circle;

the light transmissive portion and the reinforcing portion define a first line between them on a cross section of the lamp tube, the first line cuts the circle horizontally into an upper segment and a lower segment;

a second line parallel to the first line on the cross section cuts the circle horizontally into two equal halves along a diameter of the circle;

the first line rises above the second line; and the upper segment, which comprises the light transmissive portion, has a smaller area than the lower segment, which comprises the reinforcing portion.

7. The LED tube lamp in claim 3, wherein:

a cross section of the lamp tube defines a hypothetical circle;

the light transmissive portion and the reinforcing portion define a first line between them on a cross section of the lamp tube, the first line cuts the circle horizontally into an upper segment and a lower segment;

a second line parallel to the first line on the cross section cuts the circle horizontally into two equal halves along a diameter of the circle;

the first line sits exactly on the second line; and the upper segment, which encompasses the light transmissive portion, has a same area than the lower segment, which encompasses the reinforcing portion.

8. The LED tube lamp in claim 3, wherein:

the lamp tube further includes a pair of protruding bars;

the protruding bar extends in an axial direction along an inner surface of the lamp tube and is configured to form a guiding channel inside the lamp tube;

the reinforcing portion is connected to the lamp tube by sliding the reinforcing portion into the guiding channel; and the reinforcing portion is disposed inside the lamp tube.

9. The LED tube lamp in claim 3, wherein the bracing structure includes one of a vertical rib, a horizontal rib, a curvilinear rib and a combination of ribs selected from the above.

10. The LED tube lamp in claim 9, wherein:
the lamp tube further includes a ridge; and
the ridge is an elongated structure extending in an axial direction along an inner surface of the lamp tube.

11. The LED tube lamp in claim 10, wherein the ridge is broken at intervals.

12. The LED tube lamp in claim 10, wherein:
the lamp tube further includes a maintaining stick;
the ridge is a hollow structure; and
the maintaining stick fills up the space inside the ridge.

13. The LED tube lamp in claim 10, wherein the second line passes through the ridge.

14. The LED tube lamp in claim 3, wherein:
the bracing structure includes a curvilinear rib; and
two ends of the curvilinear rib connect the platform.

15. The LED tube lamp in claim 3, wherein:
the bracing structure includes a vertical rib; and
an end of the vertical rib connects the platform.

16. The LED tube lamp in claim 3, wherein an outer surface of the reinforcing portion forms an outer surface of the lamp tube.

17. The LED tube lamp in claim 3, wherein the LED light strip forms the platform.

18. An LED tube lamp, comprising:
a lamp tube, which includes a light transmissive portion, a reinforcing portion and an end cap; and
an LED light assembly, which includes an LED light source and an LED light strip, wherein:
the light transmissive portion is fixedly connected to the reinforcing portion;
the reinforcing portion includes a platform;
the LED light strip is disposed on the platform;
the reinforcing portion is made from a material having a greater stiffness than a material from which the light transmissive portion is made;
the LED light source is thermally and electrically connected to the LED light strip;
the end cap is attached to an end of the lamp tube;
the reinforcing portion is made from one of metal, metal alloy and plastic; and
a ratio of a cross-sectional area of the reinforcing portion to a cross-sectional area of the lamp tube is from 1:3 to 1:30.

19. The LED tube lamp in claim 18, wherein:
the reinforcing portion includes a curvilinear rib;
two ends of the curvilinear rib connect the platform.

20. The LED tube lamp in claim 19, wherein:
the reinforcing portion includes a vertical rib; and
an end of the vertical rib connects the curvilinear rib.

21. The LED tube lamp in claim 18, wherein:
the reinforcing portion includes a vertical rib; and
an end of the vertical rib connects the platform.

22. The LED tube lamp in claim 18, wherein:
the lamp tube further includes a pair of protruding bars;
the protruding bar extends in an axial direction along an inner surface of the lamp tube and is configured to form a guiding channel inside the lamp tube;
the reinforcing portion is connected to the lamp tube by sliding the reinforcing portion into the guiding channel; and
the reinforcing portion is disposed entirely inside the lamp tube.

* * * * *